US012102151B2

(12) United States Patent
Yorizane et al.

(10) Patent No.: US 12,102,151 B2
(45) Date of Patent: Oct. 1, 2024

(54) FIBER FOR ARTIFICIAL HAIR AND HAIR ORNAMENT PRODUCT INCLUDING SAME

(71) Applicant: Kaneka Corporation, Osaka (JP)

(72) Inventors: Mika Yorizane, Osaka (JP); Hiroshi Fujinaga, Osaka (JP); Kohei Kawamura, Osaka (JP); Tomomichi Hashimoto, Osaka (JP)

(73) Assignee: Kaneka Corporation, Osaka (JP)

( * ) Notice: Subject to any disclaimer, the term of this patent is extended or adjusted under 35 U.S.C. 154(b) by 757 days.

(21) Appl. No.: 16/050,584

(22) Filed: Jul. 31, 2018

(65) Prior Publication Data

US 2018/0343945 A1 Dec. 6, 2018

Related U.S. Application Data

(63) Continuation of application No. 14/892,863, filed as application No. PCT/JP2014/065138 on Jun. 6, 2014, now abandoned.

(30) Foreign Application Priority Data

Jun. 6, 2013 (JP) ..... 2013-119829

(51) Int. Cl.
*D01F 1/07* (2006.01)
*A41G 3/00* (2006.01)
(Continued)

(52) U.S. Cl.
CPC ..... *A41G 3/0083* (2013.01); *A41G 5/004* (2013.01); *A63H 3/44* (2013.01); *D01D 5/22* (2013.01);
(Continued)

(58) Field of Classification Search
CPC ..... A41G 3/0083; A41G 5/004; A63H 3/44; D01D 5/22; D01D 5/24; D01D 5/253;
(Continued)

(56) References Cited

U.S. PATENT DOCUMENTS 4,916,013 A * 4/1990 Maeda ..... D01F 6/62 428/397
5,954,062 A 9/1999 Murata
(Continued)

FOREIGN PATENT DOCUMENTS

CN 1826436 A 8/2006
CN 1867272 A 11/2006
(Continued)

OTHER PUBLICATIONS

Translation of KR 20030042521 A (Year: 2003).*
(Continued)

*Primary Examiner* — Matthew D Matzek
(74) *Attorney, Agent, or Firm* — Oblon, McClelland, Maier & Neustadt, L.L.P.

(57) ABSTRACT

The present invention relates to a fiber for artificial hair having a hollow in a center of a fiber cross section. A ratio of an area of the hollow to an entire area of the fiber cross section is 5% to 50%. The fiber cross section has a flat multilobed shape, and the hollow has a first side and a second side that are inclined 70 to 110 degrees relative to a major axis of the fiber cross section. The present invention also relates to hair ornament products including the above fiber for artificial hair. Thus, the present invention provides a fiber for artificial hair having a favorable curl setting property when curling with a hair iron and a favorable combing property after curling with a hair iron, and hair ornament products including the same.

20 Claims, 12 Drawing Sheets

(51) Int. Cl.

| | |
|---|---|
| ***A41G 5/00*** | (2006.01) |
| ***A63H 3/44*** | (2006.01) |
| ***D01D 5/22*** | (2006.01) |
| ***D01D 5/24*** | (2006.01) |
| ***D01D 5/253*** | (2006.01) |
| ***D01F 6/62*** | (2006.01) |
| ***D01F 6/78*** | (2006.01) |
| *D01F 6/32* | (2006.01) |
| *D01F 6/40* | (2006.01) |
| *D01F 6/60* | (2006.01) |
| *D01F 6/64* | (2006.01) |
| *D01F 6/76* | (2006.01) |
| *D01F 6/84* | (2006.01) |

(52) U.S. Cl.

CPC ..... *D01D 5/24* (2013.01); *D01D 5/253* (2013.01); *D01F 1/07* (2013.01); *D01F 6/62* (2013.01); *D01F 6/78* (2013.01); *D01F 6/32* (2013.01); *D01F 6/40* (2013.01); *D01F 6/60* (2013.01); *D01F 6/64* (2013.01); *D01F 6/765* (2013.01); *D01F 6/84* (2013.01); *D10B 2331/04* (2013.01); *D10B 2501/00* (2013.01)

(58) Field of Classification Search

CPC ..... D01F 1/07; D01F 6/62; D01F 6/78; D01F 6/32; D10B 2331/04; D10B 2501/00

USPC ..... 428/369

See application file for complete search history.

(56) References Cited

U.S. PATENT DOCUMENTS

| | | | | |
|---|---|---|---|---|
| 2006/0154062 | A1 | 7/2006 | Kowaki et al. | |
| 2006/0194044 | A1 | 8/2006 | Kowaki et al. | |
| 2007/0021543 | A1 | 1/2007 | Masuda | |
| 2008/0233395 | A1* | 9/2008 | Masuda | D01F 6/92 428/364 |
| 2009/0266372 | A1* | 10/2009 | Higami | D01D 5/253 132/53 |

FOREIGN PATENT DOCUMENTS

| | | | | |
|---|---|---|---|---|
| CN | 101516219 | A | | 8/2009 |
| JP | S6183308 | A | | 4/1986 |
| JP | 07216658 | A | * | 8/1995 |
| JP | H07216658 | A | | 8/1995 |
| JP | H07238418 | A | | 9/1995 |
| JP | H08246225 | A | | 9/1996 |
| JP | H0987966 | A | | 3/1997 |
| JP | H11217714 | A | | 8/1999 |
| JP | 2007009336 | A | | 1/2007 |
| JP | 2008007891 | A | * | 1/2008 |
| JP | 2008285772 | A | | 11/2008 |
| KR | 20030042521 | A | * | 6/2003 |
| WO | 2005037000 | A1 | | 4/2005 |
| WO | 2008035712 | A1 | | 3/2008 |

OTHER PUBLICATIONS

Glitter Definition by Merriam Webster, Sep. 2017.

International Search Report for Application No. PCT/JP2014/065138 dated Sep. 16, 2014.

KR 20030042521 A Computarized Translation; Oct. 2016.

* cited by examiner

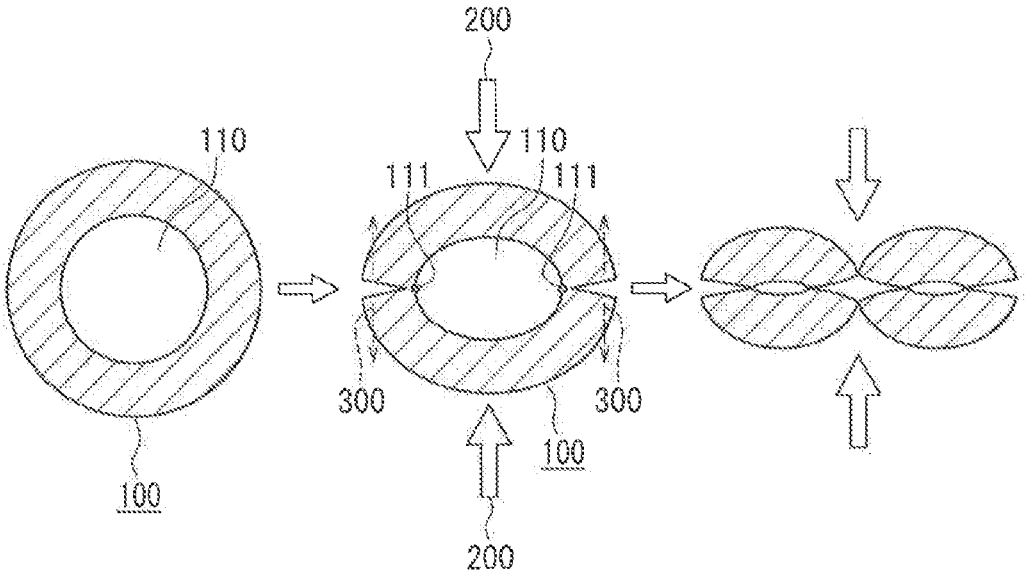
FIG. 7A FIG. 7B FIG. 7C
FIG. 8A
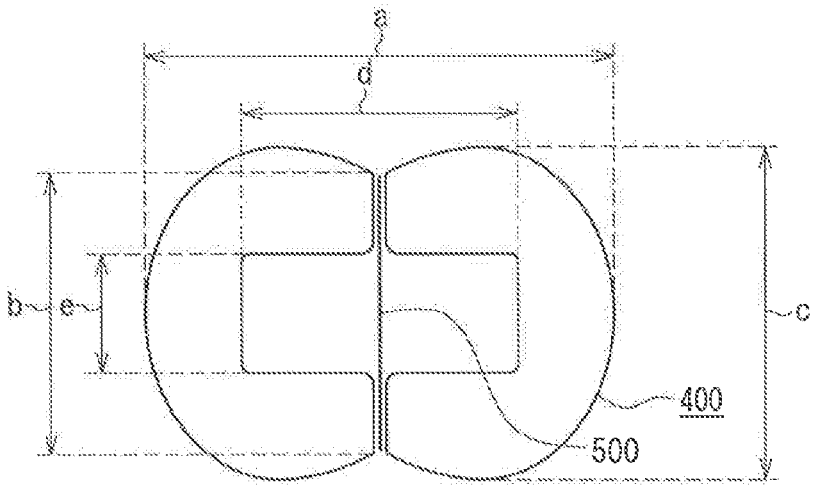
FIG. 8B
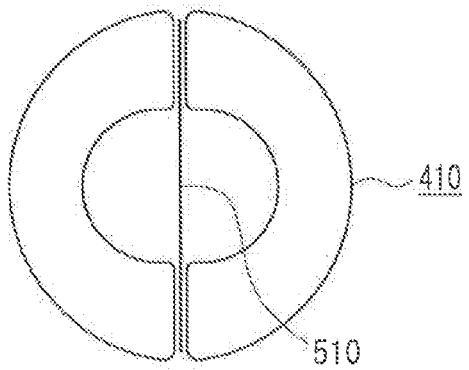

FIBER FOR ARTIFICIAL HAIR AND HAIR ORNAMENT PRODUCT INCLUDING SAME

CROSS-REFERENCE TO RELATED APPLICATIONS

The present application is a continuation of U.S. patent application Ser. No. 14/892,863, filed on Nov. 20, 2015, which claims priority from national phase entry under 35 U.S.C. § 371 of International Application No. PCT/JP2014/065138 filed Jun. 6, 2014, published as International Publication No. WO 2014/196642 A1, which claims priority from Japanese Patent Application No. 2013-119829 filed Jun. 6, 2013, all of which are incorporated herein by reference.

TECHNICAL FIELD

The present invention relates to a fiber for artificial hair that can be used as an alternative to human hair. Specifically, the present invention relates to a fiber for artificial hair having a hollow in the center of a fiber cross section, and a hair ornament product including the same.

BACKGROUND ART

Conventionally, human hair has been used for hair ornament products such as hairpieces, hair wigs, hair extensions, hair bands, and doll hair. In recent years, however, the cost of human hair increases due to difficulty in obtaining human hair, which increases the importance of artificial hair that can be substituted for the human hair. Artificial hair for hair ornament products is required to have a curl property because it is curled with a hair iron. As artificial hair that can be curled with a hair iron, Patent Document 1, for example, describes artificial hair made of polyvinyl alcohol fibers with a shrinkage percentage under dry heat at 180° C. of 10% or less and a fineness ranging from 25 to 100 deniers. As artificial hair having a curl property, Patent Document 2 describes artificial hair including hollow fibers, each having a hollow with a hollow ratio of 10 to 50%.

PRIOR ART DOCUMENTS

Patent Documents

Patent Document 1: JP 1999(H11)-217714 A
Patent Document 2: JP 2008-285772 A

DISCLOSURE OF INVENTION

Problem to be Solved by the Invention

The artificial hair of Patent Document 1 is made of a thermoplastic resin. Heating can change the shape of the artificial hair but the shape cannot be fixed at the heating temperature. The fiber needs to be cooled in a state of keeping the shape. Specifically, the fiber after curling needs to be held by hand to keep the curl shape until it is cooled to a temperature of not more than a glass transition point of the fiber. This operation is called cooling. When the cooling time was short, the artificial hair of Patent Document 1 had a poor curl setting property at the time of curling with a hair iron. The present inventors also found that the artificial hair of Patent Document 2 had a problem of significantly deteriorating a combing property after curling with a hair iron, although it had a favorable curl setting property.

In order to solve the above problems, the present invention provides a fiber for artificial hair having both properties: a favorable curl setting property when curling with a hair iron; and a favorable combing property after curling with a hair iron, and a hair ornament product including the same.

Means for Solving Problem

The present invention relates to a fiber for artificial hair having a hollow in a center of a fiber cross section. A ratio of an area of the hollow to an entire area of the fiber cross section is 5% to 50%. The fiber cross section has a flat multilobed shape. The hollow has a first side and a second side that are inclined 70 to 110 degrees relative to a major axis of the fiber cross section.

Preferably, the fiber cross section has a flat two-lobed shape comprising two circles or two ellipses connected via recessed portions. Preferably, a ratio of a length of a major axis to a length of a first minor axis in the fiber cross section is in a range from 1.2 to 3.0. Preferably, the first side and the second side of the hollow have a length of 5 μm or more. Preferably, an average value of a maximum straight line distance and a minimum straight line distance between the first side and the second side of the hollow is in a range from 20% to 180% relative to an average value of a maximum straight line distance and a minimum straight line distance between the first minor axis and a second minor axis in the fiber cross section.

Preferably, the fiber for artificial hair comprises at least one kind of resin composition selected from the group comprising a polyester-based resin composition, a polyamide-based resin composition, a vinyl chloride-based resin composition, a modacrylic-based resin composition, a polycarbonate-based resin composition, and a polyphenylene sulfide-based resin composition. More preferably, the fiber for artificial hair comprises a polyester-based resin composition comprising 100 parts by weight of a polyester resin and 5 to 40 parts by weight of a brominated epoxy-based flame retardant, wherein the polyester resin is at least one selected from the group comprising polyalkylene terephthalate and a copolymerized polyester comprising polyalkylene terephthalate as a main component. Preferably, the fiber for artificial hair is curved by gear crimping.

The present invention also relates to a hair ornament product including the fiber for artificial hair.

The hair ornament product may be any one selected from the group comprising a hair wig, a hairpiece, weaving hair, a hair extension, braided hair, a hair accessory, and doll hair. Further, the hair ornament product may be heat-treated at a temperature in a range from 120° C. to 240° C. with a hair iron.

BRIEF DESCRIPTION OF DRAWINGS

FIG. 7A is a schematic diagram of a fiber cross section of a fiber having a circular hollow.

FIG. 7B is a schematic diagram illustrating stress in the fiber cross section when an external pressure is applied to the fiber.

FIG. 7C is a schematic diagram illustrating the fiber split by the external pressure.

FIG. 8A is a schematic diagram of a nozzle used in production of fibers of Example 1.

FIG. 8B is a schematic diagram of a nozzle used in production of fibers of Comparative Example 1.

DESCRIPTION OF THE INVENTION

Figure 1:
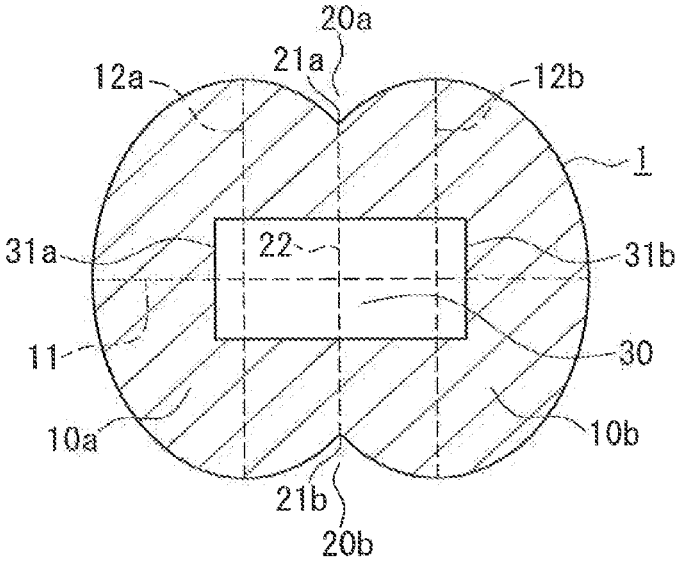
FIG. 1 is a schematic diagram showing a fiber cross section of a fiber for artificial hair in one embodiment of the present invention.

The present inventors conducted intensive studies to solve the above problems and found out that a fiber having a hollow in the center of a fiber cross section can have an excellent curl setting property when curling with a hair iron and an excellent combing property after curling with a hair iron by forming the fiber cross section to have a flat multilobed shape, e.g., a flat two-lobed shape comprising two circles or two ellipses connected via recessed portions, and in the center of the fiber cross section, forming a hollow with a first side and a second side that are inclined 70 to 110 degrees relative to a major axis of the fiber cross section. As a result, the present inventors have reached the present invention. In the present invention, the flat two-lobed shape comprising two circles or two ellipses connected via recessed portions is a substantially cocoon shape. Further, in the present invention, a hollow is formed in the center of the fiber cross section. The shape of the fiber cross section means an outer circumferential shape. In the following, a term "hair iron setting" refers to "curling with a hair iron". Further, in the following, a term "substantially perpendicular" refers to an inclination of 70 to 110 degrees.

The fiber for artificial hair of the present invention has a flat multilobed fiber cross section. The flat multilobed shape is not particularly limited as long as it has two or more lobes. Specifically, the fiber for artificial hair of the present invention may have any shape as long as it has a flat multilobed fiber cross section comprising two or more circles or ellipses connected via recessed portions.

The fiber for artificial hair of the present invention has a hollow in the center of the fiber cross section. In the present invention, the term "hollow" refers to a space that is continuously present in the fiber for at least 10 cm in the fiber axis direction, and does not include a discontinuous hollow generated by foaming or peeling in production steps of the fiber. Fibers having a continuous hollow inside are called hollow fibers, which generally have a circular or elliptical hollow as described in, e.g., Patent Document 2. The present inventors have found that the presence of a hollow in the center of the fiber cross section eliminates the need for heating and cooling to the center of the fiber during hair iron setting, increases a cross-sectional second moment as compared with those of fibers having the same fineness with no hollow, prevents the curl from loosening by its own reduced weight, and cuts a cooling time during hair iron setting.

However, when the hollow in the fiber cross section is circular or elliptical, the number of fibers with cracked cross section increases due to crimping during hair iron setting. This significantly deteriorates the combing property after hair iron setting. The reason for this is considered to be as follows: when the hollow in the fiber cross section is circular or elliptical and an external pressure is applied to the fiber, the stress concentrates on both ends (points) of the hollow and the fiber cross section cracks easily. For example, as shown in FIG. 7A, when an external pressure is applied to a fiber having a circular hollow 110 in the center of a fiber cross section 100, in many cases, an external pressure 200 deforms the fiber cross section 100 as shown in FIG. 7B, and reduces the volume of the hollow 110. Further, a deformation stress 300 concentrates on both ends (both end points) 111 of the hollow located in a direction perpendicular to the pressure 200, thereby cracking the fiber cross section 100 and collapsing the shape of the fiber cross section 100. Especially, fibers for artificial hair are crimped frequently at high temperatures during processing using a hair iron. Also in processing plants of hair ornament products, there are many steps of compressing them under high pressure including gear crimping. Hence, fibers with collapsed cross section are mixed easily. Such fibers with collapsed cross section split easily as shown in FIG. 7C and cause a tangle of fibers, thereby generating a large friction resistance and deteriorating the combing property.

In the fiber for artificial hair of the present invention, the hollow has a first side and a second side that are substantially perpendicular to the major axis of the fiber cross section. Specifically, in the fiber for artificial hair of the present invention, the first side is inclined 70 to 110 degrees relative to the major axis of the fiber cross section. Further, in the fiber for artificial hair of the present invention, the second side is inclined 70 to 110 degrees relative to the major axis of the fiber cross section. In the present invention, the term "major axis of the fiber cross section" refers to a longest straight line in the fiber cross section among symmetrical axes and straight lines connecting any two points on an outer circumference of the fiber cross section and extending parallel to the symmetrical axes.

FIG. 1 is a schematic diagram showing a fiber cross section of a fiber for artificial hair in one embodiment of the present invention. As shown in FIG. 1, in the fiber for artificial hair, a fiber cross section 1 has a flat multilobed shape, specifically, a flat two-lobed shape (also called a substantially cocoon shape) comprising two ellipses 10*a* and 10*b* connected via recessed portions 20*a* and 20*b*. A hollow 30 is formed in the center of the fiber cross section 1, and has a first side 31*a* and a second side 31*b* that are perpendicular to a major axis 11 of the fiber cross section 1. In the flat two-lobed (also called substantially cocoon-shaped) fiber cross section, the major axis of the fiber cross section is a longest straight line connecting two points on the outer circumference of the fiber cross section when any two points on the outer circumference are connected perpendicular to a straight line having a shortest straight line distance between two recessed portions. For example, in FIG. 1, a straight line having a shortest straight line distance between two recessed portions is a straight line 22 connecting a bottom point 21*a* of the recessed portion 20*a* and a bottom point 21*b* of the recessed portion 20*b*. The major axis 11 is a longest straight line connecting two points on the outer circumference of the fiber cross section when any two points on the outer circumference are connected perpendicular to the straight line 22.

Figure 2:
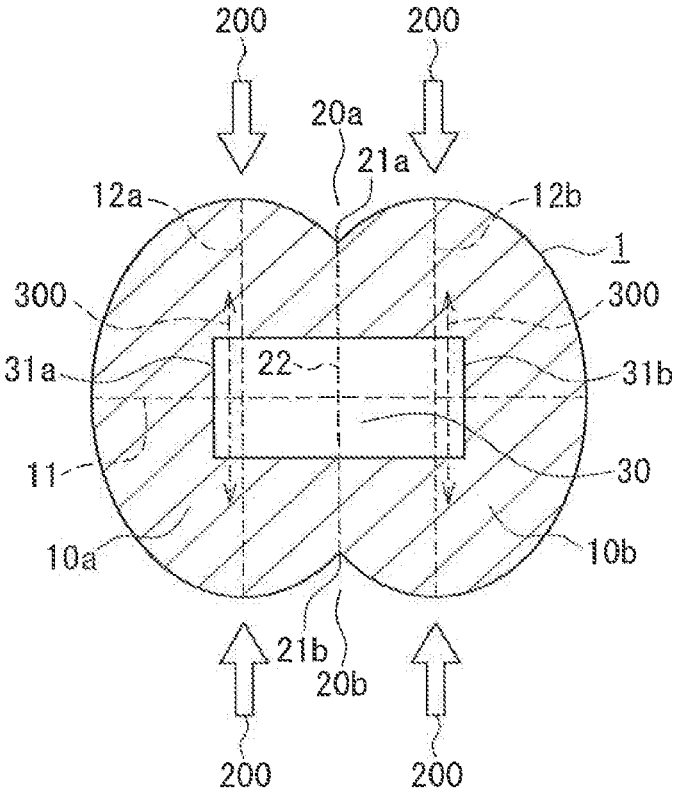
FIG. 2 is a schematic diagram illustrating stress in the fiber cross section when an external pressure is applied to the fiber for artificial hair in one embodiment of the present invention.

When an external pressure is applied to the fiber for artificial hair, as shown in FIG. 2, the external pressure 200 tends to disperse to the two ellipses 10*a* and 10*b*, which are located on the both sides of the recessed portions 20*a* and 20*b* of the fiber cross section 1, and act on vertices of four projections of the ellipses 10*a* and 10*b* in a direction perpendicular to the major axis 11. By providing the hollow 30 with the first side 31*a* and the second side 31*b* that are perpendicular to the major axis 11, the deformation stress 300 can be supported not by a point but by either the first side 31*a* or the second side 31*b* located closer to the stress direction. Thus, the fiber cross section hardly cracks.

Figure 9:
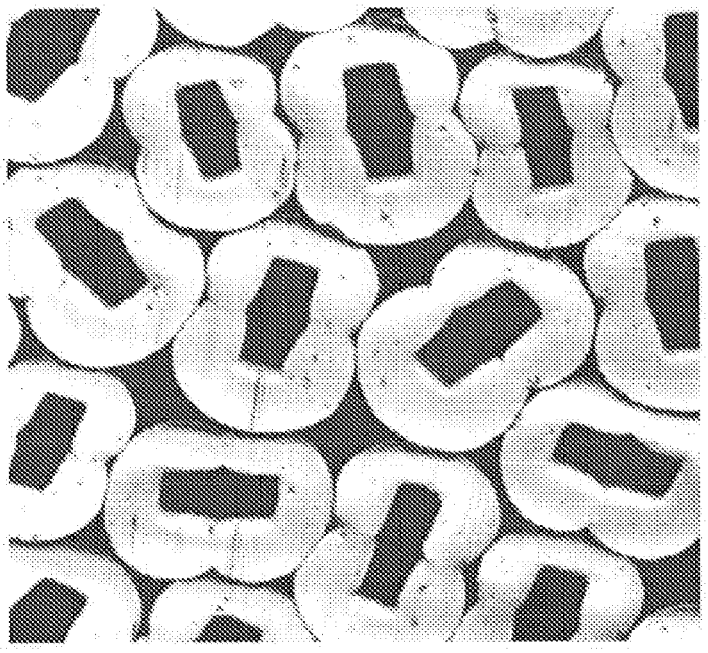
FIG. 9 is a scanning electron micrograph (400×) of fiber cross sections of fibers of Example 1.
Figure 10:
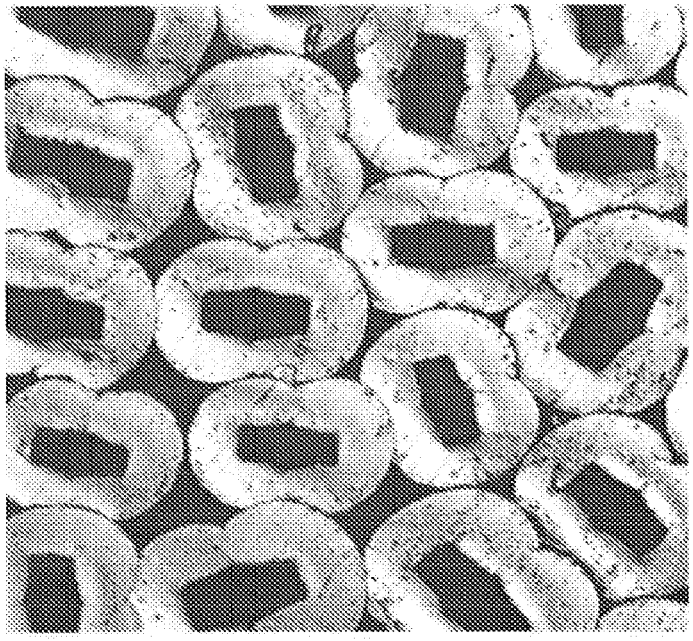
FIG. 10 is a scanning electron micrograph (400×) of fiber cross sections of the fibers of Example 1 after curling with a hair iron.
Figure 11:
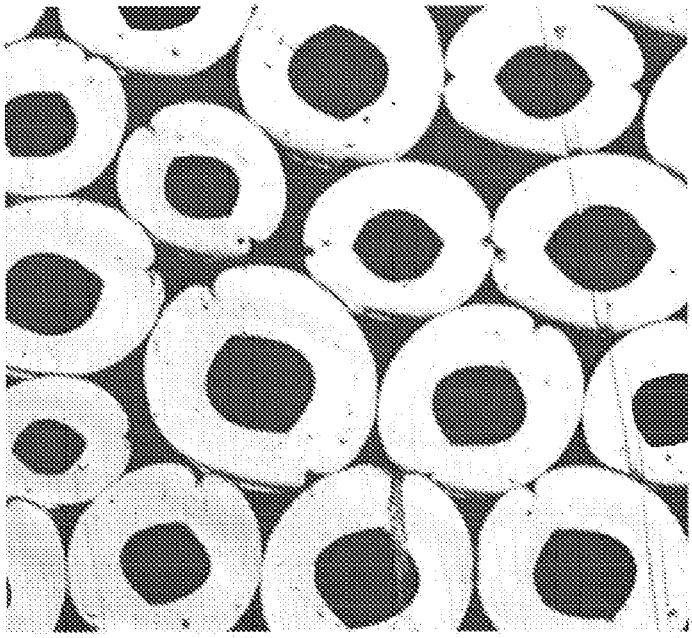
FIG. 11 is a scanning electron micrograph (400×) of fiber cross sections of fibers of Comparative Example 1.
Figure 12:
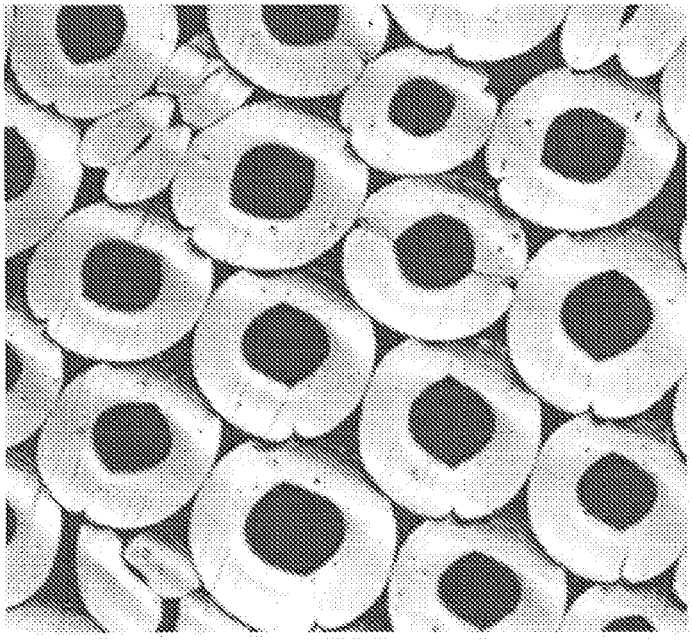
FIG. 12 is a scanning electron micrograph (400×) of fiber cross sections of the fibers of Comparative Example 1 after curling with a hair iron.

FIG. 9 is a scanning electron micrograph (400×) of the fiber cross sections of fibers of Example 1 in the present invention, and FIG. 10 is a scanning electron micrograph (400×) of the fiber cross sections of the fibers after hair iron setting. FIG. 11 is a scanning electron micrograph (400×) of the fiber cross sections of fibers of Comparative Example 1 in the present invention, and FIG. 12 is a scanning electron micrograph (400×) of the fiber cross sections of the fibers after hair iron setting. As can be seen from a comparison between FIG. 9 and FIG. 10, the fiber cross sections of the fibers of Example 1 did not crack even after hair iron setting (i.e., an external pressure was applied to the fibers), wherein each fiber has a flat two-lobed cross section comprising two circles or two ellipses connected via recessed portions, and in the center of the fiber cross section, each fiber has a hollow with a first side and a second side that are substantially perpendicular to the major axis of the fiber cross section. Meanwhile, as can be seen from a comparison between FIG. 11 and FIG. 12, part of the fiber cross sections of the fibers having a circular hollow deformed due to the hair iron setting (i.e., an external pressure was applied to the fibers), and split.

Since the fiber for artificial hair has a flat multilobed fiber cross section, projections are present on the both sides of the recessed portions. Thus, an external pressure applied to the fiber can be dispersed to the thick projections in the fiber cross section, and thus a phenomenon of collapsing the fiber cross section can be prevented. Specifically, when the fiber for artificial hair has a flat two-lobed cross section comprising two circles or two ellipses connected via recessed portions, four thick projections are present on the both sides of the two recessed portions. Thereby, an external pressure applied to the fiber can be dispersed to the four thick projections of the fiber cross section, and thus a phenomenon of collapsing the fiber cross section can be prevented.

In the fiber for artificial hair, although the shape of the circle or ellipse is not particularly limited, the ratio of the maximum length to the minimum length of straight lines passing the central point of the circle or ellipse is preferably in a range from 1 to 3, more preferably in a range from 1.1 to 2.5, and further preferably in a range from 1.2 to 2.0. When the ratio of the maximum length to the minimum length of straight lines passing the central point of the circle or ellipse is within the above range, the touch and appearance of the fiber can be maintained favorably. The circle or ellipse does not need to form a continuous arc, and may be, e.g., a substantial circle and a substantial ellipse modified partially (excluding an acute angle). It is unnecessary to consider about asperities of 2 μm or less generated on the outer circumference of the fiber cross section because of the use of additives, etc.

Figure 3:
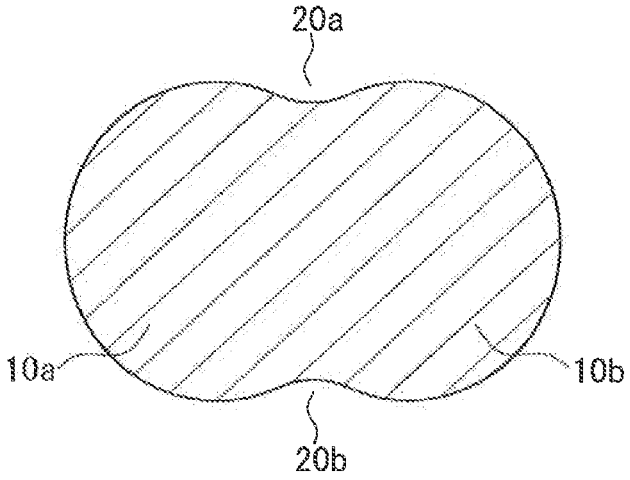
FIG. 3 is a schematic diagram of a cocoon-shaped fiber cross section.
Figure 4:
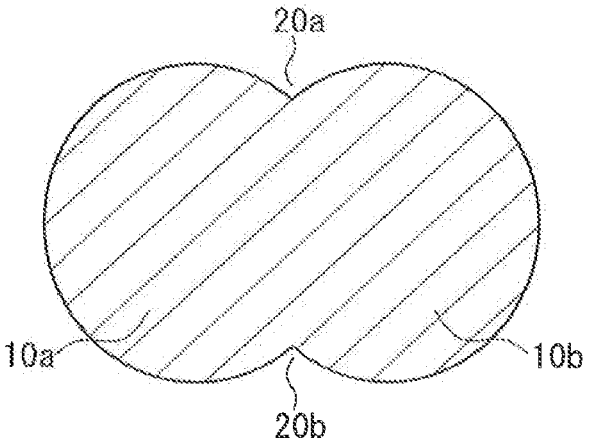
FIG. 4 is a schematic diagram of a spectacle-shaped fiber cross section.

In the flat two-lobed fiber cross section of the fiber for artificial hair, when the recessed portions connecting two circles or two ellipses are arcs, the fiber cross section has a cocoon shape. When the recessed portions connecting two circles or two ellipses are acute angles, the fiber cross section has a spectacle shape. For example, FIG. 3 is an exemplary cocoon-shaped fiber cross section that has arc recessed portions 20*a* and 20*b* connecting two ellipses 10*a* and 10*b*. FIG. 4 is an exemplary spectacle-shaped fiber cross section that has acute-angled recessed portions 20*a* and 20*b* connecting two ellipses 10*a* and 10*b*.

Figure 5:
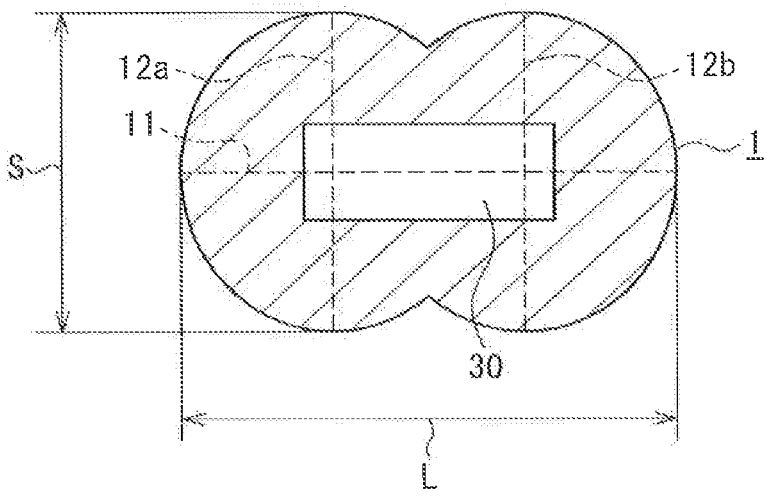
FIG. 5 is a schematic diagram illustrating a length of a major axis and a length of a first minor axis in a fiber cross section of a fiber for artificial hair in one embodiment of the present invention.

In the fiber cross section of the fiber for artificial hair, a first minor axis is a longest straight line connecting two points on the outer circumference of the fiber cross section when any two points on the outer circumference are connected perpendicular to the major axis. If two or more straight lines have a maximum length among straight lines connecting any two points on the outer circumference of the fiber cross section and extending perpendicular to the major axis, any one of them is defined as a first minor axis. For example, in the flat two-lobed fiber cross section shown in FIGS. 1 and 2, the first minor axis is a straight line 12*a* connecting vertices of two projections present in the ellipses 10*a* and 10*b*. In the fiber cross section of the fiber for artificial hair, the ratio of the length of the major axis to the length of the first minor axis is preferably in a range from 1.2 to 3.0, and more preferably in a range from 1.3 to 1.8. In the present invention, "the ratio of the length of the major axis to the length of the first minor axis" is an average value in 30 fiber cross sections selected randomly. Preferably, in the 30 fiber cross sections selected randomly, a maximum value and a minimum value among the ratios of the length of the major axis to the length of the first minor axis are both within the above range. For example, in the flat two-lobed fiber cross section shown in FIG. 5, a ratio L/S of a length L of a major axis 11 to a length S of a first minor axis 12*a* is preferably in a range from 1.2 to 3.0, and more preferably in a range from 1.3 to 1.8. The fiber for artificial hair of the present invention prevents a phenomenon of collapsing the fiber cross section by adopting a support structure that aligns the direction of pressure applied to the fiber, and thus disperses the pressure. This structure utilizes a tendency that under external pressure the minor axes of the fiber are oriented parallel to the direction of the pressure. As described above, when the ratio of the length of the major axis to the length of the first minor axis in the fiber cross section is 1.2 or more, the fiber cross section is less likely to collapse, a tangle of fibers is avoided, and the combing property does not deteriorate. Further, when the ratio of the length of the major axis to the length of the first minor axis is 3.0 or less, the touch and appearance of the fiber can be maintained favorably.

In the flat two-lobed fiber cross section, a distance between the two recessed portions is not particularly limited as long as it is shorter than the first minor axis. The ratio of the straight line distance between the bottom points of the two recessed portions to the length of the first minor axis is preferably in a range from 0.5 or more and less than 1, more preferably in a range from 0.5 to 0.9, and further preferably in a range from 0.7 to 0.9. In the present invention, "the ratio of the straight line distance between the bottom points of the two recessed portions to the length of the first minor axis" is an average value in 30 fiber cross sections selected randomly. Preferably, in the 30 fiber cross sections selected randomly, a maximum value and a minimum value among the ratios of the straight line distance between the bottom points of the two recessed portions to the length of the first minor axis are both within the above range. When the ratio of the straight line distance between the bottom points of the two recessed portions to the length of the first minor axis is 0.5 or more, a hollow can be formed in the center of the fiber cross section, thereby shortening a cooling time during hair iron setting and enhancing a curl setting property. Further, when the ratio of the straight line distance between the bottom points of the two recessed portions to the length of the first minor axis is less than 1, a pressure applied to the fiber can be dispersed easily to the four projections on the both sides of the two recessed portions, whereby the fiber cross section does not deform under pressure and the hollow volume does not decrease. Further, when the ratio of the straight line distance between the bottom points of the two recessed portions to the length of the first minor axis is less than 1, a flat area on the fiber surface decreases, and reflection of light on the fiber surface decreases accordingly. Thus, the fiber is likely to have a gloss close to human hair.

The fiber for artificial hair has a hollow in the center of the fiber cross section, wherein the hollow has a first side and a second side that are inclined 70 to 110 degrees relative to the major axis of the fiber cross section. With this configuration, when a pressure is applied to the fiber, the hollow can support the pressure by lines (first and second sides), not by a point as in the case of a circular or elliptical hollow. Thus, concentration of stress on a particular part (point) can be avoided and a phenomenon of collapsing the fiber cross section can be prevented. In the fiber cross section, the first side is preferably inclined in a range from 80 to 100 degrees relative to the major axis. Further, in the fiber cross section, the second side is preferably inclined in a range from 80 to 100 degrees relative to the major axis. In the present invention, the "angle of the first side relative to the major axis" is an average value in 30 fiber cross sections selected randomly. Preferably, in the 30 fiber cross sections selected randomly, a maximum value and a minimum value among the angles of the first side relative to the major axis are both within the above range. Further, in the present invention, the "angle of the second side relative to the major axis" is an average value in 30 fiber cross sections selected randomly. Preferably, in the 30 fiber cross sections selected randomly, a maximum value and a minimum value among the angles of the second side relative to the major axis are both within the above range. Further, in the fiber cross section, the first side and the second side are preferably approximately parallel to each other. Specifically, an angle between the first side and the second side is preferably in a range from 0 to 40 degrees. By setting the first side and the second side to be inclined in a range from 70 to 110 degrees relative to the major axis of the fiber cross section, a hollow wall (first and second sides) can support a pressure greatly, thereby keeping the shape of the fiber cross section, avoiding a tangle of fibers, and enhancing a combing property.

Figure 6A:
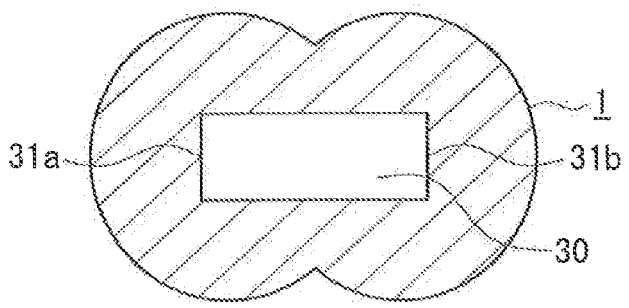
FIG. 6A is a schematic diagram of a flat two-lobed fiber cross section having a quadrangular hollow.
Figure 6B:
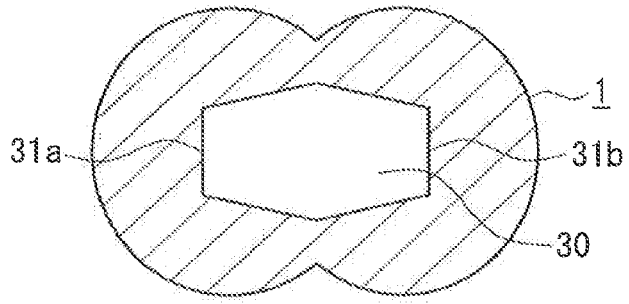
FIG. 6B is a schematic diagram of a flat two-lobed fiber cross section having a hexagonal hollow.
Figure 6C:
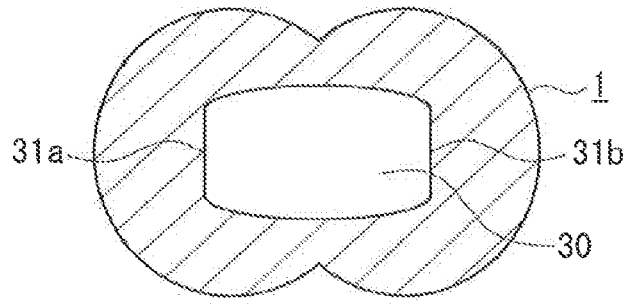
FIG. 6C is a schematic diagram of a flat two-lobed fiber cross section having a hollow in a combined shape of a quadrangle and arcs.

The specific shape of the hollow is not particularly limited, and any shape that has a first side and a second side substantially perpendicular to the major axis of the fiber cross section may be adopted. Examples of the shape of the hollow include a quadrangle as shown in FIG. 6A, a hexagon as shown in FIG. 6B, and a combination of a quadrangle and arcs as shown in FIG. 6C. FIGS. 6A to 6C respectively illustrate flat two-lobed cross sections. In terms of capable of increasing the hollow ratio, dispersing an angular stress, and preventing surface reflection, the shape of the hollow is preferably a hexagon, or a combination of a quadrangle and arcs.

In the fiber cross section of the fiber for artificial hair, the first side and the second side of the hollow have a length of preferably 5 μm or more, more preferably 5 μm to 50 μm, and further preferably 10 μm to 30 μm. In the present invention, the "length of the first side of the hollow" is an average value in 30 fiber cross sections selected randomly. Preferably, in the 30 fiber cross sections selected randomly, a maximum value and a minimum value of the lengths of the first side of the hollow are both within the above range. Further, in the present invention, the "length of the second side of the hollow" is an average value in 30 fiber cross sections selected randomly. Preferably, in the 30 fiber cross sections selected randomly, a maximum value and a minimum value of the lengths of the second side of the hollow are both within the above range. When the first side and the second side have a length of 5 μm or more, local stress concentration can be avoided, which keeps the shape of the fiber cross section, avoids a tangle of fibers, and enhances a combing property. Further, when the first side and the second side have a length of 50 μm or less, the outer circumference of the fiber is spaced apart from the outer circumference of the hollow, which allows the fiber to have an enough thickness, keeps the shape of the fiber cross section, avoids a tangle of fibers, and enhances a combing property.

In the fiber cross section of the fiber for artificial hair, a second minor axis is a straight line connecting vertices of two projections interposing the recessed portions with respect to the first minor axis. The lengths of the first minor axis and the second minor axis may be the same or different from each other. For example, in FIGS. 1 and 2, the second minor axis is a straight line 12*b* connecting the vertices of two projections, interposing two recessed portions 20*a* and 20*b* with respect to a first minor axis 12*a*. Although the hollow is preferably positioned nearer to the center than the four projections of the fiber cross section, a distance between the first minor axis and the second minor axis may be increased within the following range to increase the hollow ratio.

An average value of a maximum straight line distance and a minimum straight line distance between the first side and the second side of the hollow (hereinafter, also referred to as an average distance between the sides of the hollow) is preferably in a range from 20% to 180%, and more preferably in a range from 50% to 150% relative to an average value of a maximum straight line distance and a minimum straight line distance between the first minor axis and the second minor axis of the fiber cross section (hereinafter, also referred to as an average distance between the minor axes of the cross section). In the present invention, a "ratio of the average distance between the sides of the hollow to the average distance between the minor axes of the cross section" is an average value in 30 fiber cross sections selected randomly. Preferably, in the 30 fiber cross sections selected randomly, a maximum value and a minimum value among the ratios of the average distance between the sides of the hollow to the average distance between the minor axes of the cross section are both within the above range. When the average distance between the sides of the hollow is 20% or more relative to the average distance between the minor axes of the cross section, an enough initial hollow ratio can be obtained easily while the cooling time can be shortened easily. Further, when the average distance between the sides of the hollow is 180% or less relative to the average distance between the minor axes of the cross section, a distance from supporting points (vertices of the four projections) of the fiber cross section, to which a pressure is applied, to the hollow wall (first and second sides), which serves as support columns, becomes shorter. This prevents the fiber cross section from deforming easily and the hollow ratio from decreasing, and shortens the cooling time easily.

In the fiber for artificial hair, the ratio of the area of the hollow to the entire area of the fiber cross section is 5% to 50%. In the present invention, the entire area of the fiber cross section refers to an area surrounded by the outer circumference portion of the fiber in the perpendicularly sliced fiber cross section including the area of the hollow portion. Hereinafter, "the ratio of the area of the hollow to the entire area of the fiber cross section" also is referred to as a "hollow ratio". In the fiber for artificial hair, the presence of the hollow in the center of the fiber cross section eliminates heating and cooling to the center of the fiber during hair iron setting, thereby shortening the cooling time. Further, formation of a hollow in the fiber cross section increases a distance from the center of gravity to the outer circumference portion as compared with a fiber having the same area (fineness) with no hollow, thereby increasing a secondary cross sectional moment and enhancing the curl strength accordingly. Further, a fiber bundle (hair bundle) of fibers having a hollow in the fiber cross sections is lighter than a fiber bundle of fibers of the same volume with no hollow, which reduces a curl loosening phenomenon caused by its own weight with time. As described above, a larger hollow is desired in terms of keeping the curl shape. On the other hand, a larger hollow relatively reduces the thickness of the fiber, making it difficult to keep the shape of the fiber cross section and increasing a possibility of fiber deformation or collapse under pressure. When the hollow ratio in the fiber cross section is less than 5%, a cooling time cannot be shortened. When the hollow ratio in the fiber cross section exceeds 50%, the shape of the fiber cross section is highly unlikely to be kept. In terms of capable of shortening a cooling time, keeping the shape of the fiber cross section easily, preventing a tangle of fibers, and enhancing a combing property, the hollow ratio in the fiber cross section is preferably 10% to 40%, and more preferably 15% to 30%. In the present invention, "the ratio of the area of the hollow to the entire area of the fiber cross section" is an average value in 30 fiber cross sections selected randomly. Preferably, in the 30 fiber cross sections selected randomly, a maximum value and a minimum value among the ratios of the area of the hollow to the entire area of the fiber cross section are both within the above range.

Not all the fibers for artificial hair are required to have the same fineness, cross-sectional shape, cross-sectional size, hollow shape, hollow area, or hollow size, and they may be a mixture of fibers having a different fineness, cross-sectional shape, cross-sectional size, hollow shape, hollow area, or hollow size.

A composition of the fiber for artificial hair is not particularly limited. For example, the fiber for artificial hair may comprise a resin composition such as a polyester-based resin composition, a polyamide-based resin composition, a vinyl chloride-based resin composition, a modacrylic-based resin composition, a polycarbonate-based resin composition, and a polyphenylene sulfide-based resin composition. These resin compositions may be used in combination of two or more kinds. In terms of flame retardancy, a flame retardant may be used together. Preferably, a polyester-based resin composition that is a combination of a polyester-based resin and a bromine-based polymeric flame retardant, a polyamide-based resin composition that is a combination of a polyamide-based resin and a bromine-based polymeric flame retardant, etc., are used.

In terms of heat resistance and flame retardancy, the fiber for artificial hair preferably comprises a polyester-based resin composition comprising a polyester resin and a bromine-based polymeric flame retardant. Specifically, the fiber for artificial hair may be obtained by melt spinning a polyester-based resin composition comprising a polyester resin and a bromine-based polymeric flame retardant. More preferably, the fiber for artificial hair comprises a polyester-based resin composition comprising 100 parts by weight of at least one kind of polyester resin selected from the group comprising polyalkylene terephthalate and a copolymerized polyester comprising polyalkylene terephthalate as the main component and 5 to 40 parts by weight of a bromine-based polymeric flame retardant.

The polyester resin is at least one kind of resin selected from the group comprising polyalkylene terephthalate and a copolymerized polyester comprising polyalkylene terephthalate as the main component. The polyalkylene terephthalate is not particularly limited and may be, e.g., polyethylene terephthalate, polypropylene terephthalate, polybutylene terephthalate, or polycyclohexane dimethylene terephthalate. The copolymerized polyester comprising polyalkylene terephthalate as the main component is not particularly limited and may be, e.g., a copolymerized polyester comprising polyalkylene terephthalate (such as polyethylene terephthalate, polypropylene terephthalate, polybutylene terephthalate, or polycyclohexane dimethylene terephthalate) as the main component and other copolymerizable components. In the present invention, the term "main component" means "comprising the component in an amount of 80 mol % or more". Thus, the "copolymerized polyester comprising polyalkylene terephthalate as the main component" refers to copolymerized polyester comprising 80 mol % or more of polyalkylene terephthalate.

Examples of the other copolymerizable components include the following: polycarboxylic acids such as isophthalic acid, orthophthalic acid, naphthalenedicarboxylic acid, paraphenylenedicarboxylic acid, trimellitic acid, pyromellitic acid, succinic acid, glutaric acid, adipic acid, suberic acid, azelaic acid, sebacic acid, and dodecanedioic acid, and their derivatives; dicarboxylic acids including a sulfonic acid salt such as 5-sodiumsulfoisophthalic acid and dihydroxyethyl 5-sodiumsulfoisophthalate, and their derivatives; 1,2-propanediol; 1,3-propanediol; 1,4-butanediol; 1,6-hexanediol; neopentyl glycol; 1,4-cyclohexanedimethanol; diethylene glycol; polyethylene glycol; trimethylolpropane; pentaerythritol; 4-hydroxybenzoic acid; ε-caprolactone; and ethylene glycol ether of bisphenol A.

In terms of stability and simplicity of operation, the copolymerized polyester is preferably produced by adding a small amount of the other copolymerizable components to polyalkylene terephthalate as the main component to react them. Polyalkylene terephthalate may be, e.g., a polymer of terephthalic acid and/or a derivative thereof (e.g., methyl terephthalate) and alkylene glycol. The copolymerized polyester may be produced by polymerization of a composition obtained by adding a monomer or oligomer component as the small amount of the other copolymerizable components, to a mixture of terephthalic acid and/or a derivative thereof (e.g., methyl terephthalate) and alkylene glycol used for polymerization of polyalkylene terephthalate as the main component.

As the copolymerized polyester, any copolymerized polyester may be used in which the other copolymerizable component is polycondensed to a main chain and/or side chain of polyalkylene terephthalate as the main component, and the copolymerization method is not particularly limited.

Specific examples of the copolymerized polyester comprising polyalkylene terephthalate as a main component include a copolymerized polyester obtained by copolymerization of polyethylene terephthalate as the main component with one kind of compound selected from the group comprising ethylene glycol ether of bisphenol A, 1,4-cyclohexanedimethanol, isophthalic acid, and dihydroxyethyl 5-sodiumsulfoisophthalate.

The polyalkylene terephthalate and the copolymerized polyester comprising polyalkylene terephthalate as the main component may be used individually or in combinations of two or more. In particular, it is preferable that polyethylene terephthalate; polypropylene terephthalate; polybutylene terephthalate; a copolymerized polyester obtained by copolymerization of polyethylene terephthalate as the main component with ethylene glycol ether of bisphenol A; a copolymerized polyester obtained by copolymerization of polyethylene terephthalate as the main component with 1,4-cyclohexanedimethanol; a copolymerized polyester obtained by copolymerization of polyethylene terephthalate as the main component with isophthalic acid; and a copolymerized polyester obtained by copolymerization of polyethylene terephthalate as the main component with dihydroxyethyl 5-sodiumsulfoisophthalate are used individually or in combinations of two or more.

Although an intrinsic viscosity (IV value) of the polyester resin is not particularly limited, the intrinsic viscosity is preferably 0.3 to 1.2, and more preferably 0.4 to 1.0. When the intrinsic viscosity is 0.3 or more, the mechanical strength of fibers to be obtained does not decrease, and there is no risk of dripping during a combustion test. Further, when the intrinsic viscosity is 1.2 or less, the molecular weight does not increase excessively, and the melt viscosity does not become too high. Thus, melt spinning can be performed easily, and the fineness of fibers is likely to be uniform.

The bromine-based polymeric flame retardant is preferably a brominated epoxy-based flame retardant in terms of heat resistance and flame retardancy. The brominated epoxy-based flame retardant may use as a raw material a brominated epoxy-based flame retardant having an epoxy group or tribromophenol at the end of the molecule. The structure of the brominated epoxy-based flame retardant after melt kneading is not particularly limited and may have 80 mol % or more of the constitutional unit represented by the following chemical formula (1), where the total amount of the constitutional unit represented by the chemical formula (1) and another constitutional unit in which at least part of the chemical formula (1) is modified is 100 mol %. The structure of the brominated epoxy-based flame retardant at the end of the molecule may be changed after melt kneading. For example, the end of the molecule of the brominated epoxy-based flame retardant may be replaced by a hydroxyl group other than the epoxy group or tribromophenol, a phosphoric acid group, a phosphonic acid group, or the like. Alternatively, the end of the molecule of the brominated epoxy-based flame retardant may be bound to a polyester component through an ester group. Moreover, part of the structure of the brominated epoxy-based flame retardant, except for the end of the molecule, may be changed. For example, the brominated epoxy-based flame retardant may have a branched structure in which the secondary hydroxyl group and the epoxy group are bound. Also, part of the bromine of the chemical formula (1) may be eliminated or added, as long as the bromine content in the molecule of the brominated epoxy-based flame retardant is not changed significantly.

[Chemical formula 1]

(1)

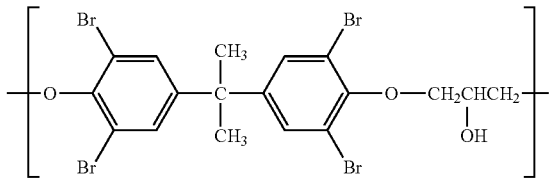

The brominated epoxy-based flame retardant is preferably a polymeric brominated epoxy-based flame retardant, e.g., as represented by the following general formula (2). The polymeric brominated epoxy-based flame retardant represented by the general formula (2) may be a commercially available product such as a brominated epoxy-based flame retardant (trade name "SR-T2MP") manufactured by SAKAMOTO YAKUHIN KOGYO CO., LTD.

[Chemical formula 2]

(2)

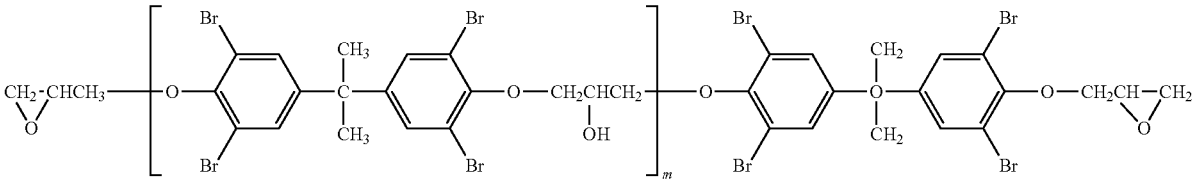

In the above general formula (2), m is 1 to 1000.

As necessary, the fiber for artificial hair may comprise various additives such as flame retardants other than the brominated epoxy-based flame retardant, flame retardant auxiliaries, heat resistant agents, stabilizers, fluorescers, antioxidants, antistats, and pigments, as long as they do not interfere with the effects of the present invention.

Examples of the flame retardants other than the brominated epoxy-based flame retardant include phosphorus-containing flame retardants and bromine-containing flame retardants. Examples of the phosphorus-containing flame retardants include a phosphoric ester amide compound and an organic cyclic phosphorus based compound. Examples of the bromine-containing flame retardants include the followings: bromine-containing phosphoesters such as pentabromotoluene, hexabromobenzene, decabromodiphenyl, decabromodiphenyl ether, bis(tribromophenoxy)ethane, tetrabromophthalic anhydride, ethylene bis(tetrabromophthalimide), ethylene bis(pentabromophenyl), octabromotrimethylphenylindan, and tris(tribromoneopentyl)phosphate; brominated polystyrenes; brominated polybenzyl acrylates; brominated phenoxy resin; brominated polycarbonate oligomers; tetrabromobisphenol A and tetrabromobisphenol A derivatives such as tetrabromobisphenol A-bis(2,3-dibromopropyl ether), tetrabromobisphenol A-bis(allylether), and tetrabromobisphenol A-bis(hydroxyethyl ether); bromine-containing triazine based compounds such as tris(tribromophenoxy)triazine; and bromine-containing isocyanuric acid compounds such as tris(2,3-dibromopropyl)isocyanurate. In particular, the phosphoric ester amide compound, the organic cyclic phosphorus based compound, and the brominated phenoxy resin flame retardant are preferred because of their excellent flame retardancy.

Examples of the flame retardant auxiliaries include antimony-based compounds and composite metals comprising antimony. Examples of the antimony-based compound include antimony trioxide, antimony tetroxide, antimony pentoxide, sodium antimonate, potassium antimonate, and calcium antimonate. In terms of an effect of improving flame retardancy and an influence on touch, antimony trioxide, antimony pentoxide, and sodium antimonate are more preferred.

The production method of the fiber for artificial hair is not particularly limited, as long as it enables production of fibers having a continuous hollow in the axis direction of the fibers. Example methods include as follows: by using a conjugate nozzle to pass air in a central portion to form a hollow; by using a conjugate nozzle to produce a fiber having a core-in-sheath structure using a soluble composition in a central portion, which is to be eluted in a later step to form a hollow; and by bonding a material beneath a plurality of discharge holes that extrude the material. As a method for bonding a material beneath a plurality of discharge holes that extrude the material, specifically, it is possible to use a method of setting a lattice inside a nozzle land so as to separate the fiber into two or more parts, followed by thermal fusion bonding.

When the fiber for artificial hair comprises a thermoplastic resin composition such as a polyester-based resin composition, the thermoplastic resin composition is melt kneaded using various general kneading machines, and then is formed into pellets. Subsequently, these pellets are melt spun so that the fiber for artificial hair can be produced. For example, when the fiber for artificial hair comprises a polyester-based resin composition, it can be produced by the following production method. The polyester-based resin composition, which is obtained by dry blending the respective components including the above polyester resin and brominated epoxy-based flame retardant, is melt kneaded using various general kneading machine, and then is formed into pellets. Subsequently, these pellets are melt spun so that the fiber for artificial hair can be produced. The polyester-based resin composition may include other thermoplastic resins such as polycarbonate-based resins as needed. Further, when the fiber for artificial hair comprises a polyamide-based resin composition, the polyamide-based resin composition is melt kneaded using various general kneading machines, and then is formed into pellets. Subsequently, these pellets are melt spun so that the fiber for artificial hair can be produced. Examples of the kneading machines include a single-screw extruder, a twin-screw extruder, a roll, a Banbury mixer, and a kneader. In particular, the twin-screw extruder is preferred in terms of adjustment of the degree of kneading and simplicity of operation.

As for the melt spinning, for example, the polyester-based resin composition is melt spun into yarns while the temperatures of an extruder, a gear pump, a spinneret, etc. are set at 250° C. to 300° C. Then, spun yarns are caused to pass through a heated tube, cooled to a temperature of not more than a glass transition point of the polyester resin, and wound up at a speed of 50 to 5000 m/min. Thus, spun yarns (undrawn yarns) are obtained. Further, for example, the polyamide-based resin composition is melt spun into yarns while the temperatures of an extruder, a gear pump, a spinneret, etc. are set at 260° C. to 320° C. Then, spun yarns are caused to pass through a heated tube, cooled to a temperature of not more than a glass transition point of the polyamide resin, and wound up at a speed of 50 to 5000 m/min. Thus, spun yarns (undrawn yarns) are obtained. In this process, the use of the above particular nozzle allows production of fibers with a hollow. In terms of the equipment load, productivity, and the control of the cross-sectional shape it is preferable to use the method of forming a hollow by setting a lattice inside a nozzle land so as to separate the fiber into two or more parts, followed by thermal fusion bonding. Moreover, the spun yarns may be cooled in a water bath containing cooling water to control the fineness. The temperature and length of the heated tube, the temperature and amount of the cooling air to be applied, the temperature of the cooling water bath, the cooling time, and the winding speed can be set appropriately in accordance with the extrusion rate of the polymer and the number of holes of the spinneret.

The resultant spun yarns (undrawn yarns) are preferably hot drawn. The drawing may be performed by either a two-step method or a direct spinning-drawing method. In the two-step method, the spun yarns are once wound, and then drawn. In the direct spinning-drawing method, the spun yarns are drawn continuously without winding. The hot drawing may be performed by a single-stage drawing method or a multi-stage drawing method that includes two or more stages. The heating means for the hot drawing may be, e.g., a heating roller, a heat plate, a steam jet apparatus, or a hot water bath, and they can be used in combination appropriately.

Moreover, oils such as a fiber treatment agent and a softening agent may be added to the fiber for artificial hair, so that the touch and feel of the fiber can be closer to the human hair. The fiber treatment agent may be, e.g., a silicone-based fiber treatment agent or a non-silicone-based fiber treatment agent, which serve to improve the touch and combing property.

The single fiber fineness of the fiber for artificial hair is preferably 10 to 150 dtex, more preferably 30 to 100 dtex, and further preferably 40 to 80 dtex because the fineness within these ranges is suitable for artificial hair.

The fiber for artificial hair may be subjected to gear crimping. This imparts gentle curves and natural appearance to the fiber, and decreases cohesion between fibers, thereby improving the combing property. In the gear crimping, generally, the fiber is caused to pass through two engaged gears while being heated to a temperature higher than its softening temperature. Thus, the shape of the gears is transferred to the fiber and curves appear on the fiber. At this time, the fiber should be crimped under high pressure by the gears to obtain uniform curves. In the case of the fiber having a circular or elliptical hollow, the shape of fiber cross section may lose. Meanwhile, the fiber for artificial hair has a flat-multilobed cross section, e.g., a flat two-lobed cross section comprising two circles or two ellipses connected via recessed portions, and in the center of the fiber cross section, has a hollow having a first side and a second side that are substantially perpendicular to the major axis of the fiber cross section. Therefore, as described above, even when the fiber is crimped under high pressure by the gears, the shape of the fiber cross section is less likely to lose, and uniform curves are imparted to the fiber easily.

The fiber for artificial hair of the present invention has a favorable curl setting property when curling with a hair iron and a favorable combing property after curling with a hair iron.

The curl setting property of the fiber for artificial hair when curling with a hair iron can be determined from the curl setting property during hair iron setting and the curl retentive property. The curl setting property during hair iron setting and the curl retentive property can be evaluated as described below. For the curl setting property during hair iron setting, it is preferred that the curl style is at an acceptable level, and it is more preferred that the curl strength is high and the curl style is excellent. For the curl retentive property, it is preferred that a curl loosening percentage three days after curling is less than 10%, a change in style from that immediately after curling is relatively low, and curls as a whole remain spirally, and it is more preferred that the curl loosening percentage is less than 5%, a change in style from that immediately after curling is low, and curls as a whole remain spirally.

The combing property of the fiber for artificial hair can be determined from the combing property after hair iron setting. The combing property after hair iron setting can be evaluated as described below. The combing property after hair iron setting is measured on a fiber bundle for combing property evaluation prepared by repeating five times a process of crimping the fixed fiber bundle from the base to the tip while heating. It is preferred that the number of deformed or split fibers after 100 times of combing is less than 100 in a fiber bundle for combing property evaluation, and that although the fibers get more resistance in the middle, the number of times the comb cannot pass through to the end is less than 20 times in 100 times. It is more preferred that the number of deformed or split fibers after 100 times of combining is less than 30, and that the fibers are at least combed through to the end even though the resistance gets slightly high in the middle, and it is further preferred that the number of deformed or split fibers after 100 times of combining is less than 10, and the fibers are combed through to the end with no resistance.

The fiber for artificial hair can be used for any hair ornament products. For example, the fiber for artificial hair can be used for hair wigs, hairpieces, weavings, hair extensions, braided hair, hair accessories, and doll hair. Since the fiber for artificial hair is excellent in curl setting property during hair iron setting and in combing property after hair iron setting, it is preferably used for hair wigs, hairpieces, and weavings that are often subjected to hair ironing. Further, the fiber for artificial hair can be suitably used for hair ornament products that include fibers to be curved by gear crimping.

The above hair ornament products may comprise only the fiber for artificial hair of the present invention. Moreover, the hair ornament products may be provided by combining the fiber for artificial hair of the present invention with other artificial hair fibers and natural fibers such as human hair or animal hair. The hair ornament products may be heat-treated at a temperature in a range from 180° C. to 240° C. with a hair iron. Thereby, curls are imparted to the hair ornament products, and it is possible to provide hair ornament products having favorable curl properties such as a curl setting property and a curl retentive property and having an excellent combing property.

EXAMPLES

Hereinafter, the present invention will be described in more detail based on examples. However, the present invention is not limited to the examples.

The following compounds were used in the examples and the comparative examples:

- Polyethylene terephthalate—trade name "BK-2180" manufactured by Mitsubishi Chemical Corporation;
- Brominated epoxy-based flame retardant—trade name "SR-T2MP" manufactured by SAKAMOTO YAKUHIN KOGYO CO., LTD.;
- Sodium antimonate—trade name "SA-A" manufactured by NIHON SEIKO CO., LTD.;
- Polycarbonate—trade name "Panlite (registered trademark) K-1300Y" manufactured by Teijin Chemicals Limited (presently Teijin Limited);
- Nylon 66—trade name "Zytel (registered trademark)-42A" manufactured by DuPont;
- Antimony trioxide—trade name "PATOX-M" manufactured by NIHON SEIKO CO., LTD.

The following measurement and evaluation methods are used in the examples and the comparative examples below.

(Single Fiber Fineness)

The single fiber fineness was determined by averaging single fiber finenesses of 30 samples, which were measured using an auto-vibronic fineness measuring instrument, "DENIER COMPUTER type DC-11" (manufactured by Search Co., Ltd.).

(Evaluation of Fiber Cross Section)

Fibers were cut into 150 mm long, and 0.7 g of the cut fibers was bundled. The fiber bundle was passed through a rubber tube, followed by shrinkage of the rubber tube under heat at 80° C. for fixing the fiber bundle to avoid displacement. Then, the tube part was cut into a round slice with a cutter to prepare a 5 mm-long fiber bundle for a cross-sectional observation. The fiber bundle was photographed by a scanning electron microscope ("S-3500N" manufactured by Hitachi High-Technologies Corporation) at 400× magnification. Thus, a micrograph of the fiber cross sections was obtained. From this micrograph of the fiber cross sections, 30 fiber cross sections were selected randomly for the following measurements using an image analyzer (image analysis software "Win ROOF" manufactured by MITANI CORPORATION): the length of the major axis, the length of the first minor axis, the angle of the first side of the hollow relative to the major axis, the angle of the second side of the hollow relative to the major axis, the length of the first side of the hollow, the length of the second side of the hollow, the hollow area, and the fiber cross-sectional area. In the fiber for artificial hair of the present invention, each size in the fiber cross section can be expressed by an average value of the measured values of the randomly selected 30 fiber cross sections (e.g., the ratio of the length of the major axis to the length of the first minor axis, the angle of the first side of the hollow relative to the major axis, the angle of the second side of the hollow relative to the major axis, the length of the first side of the hollow, the length of the second side of the hollow, the ratio of the average distance between the sides of the hollow to the average distance between the minor axes of the cross section, and the hollow ratio (hollow area ratio))

(Curl Setting Property During Hair Iron Setting)

Fibers were cut into 63.5 cm long, and 5.0 g of the 63.5 cm-long fibers obtained was bundled. The fiber bundle was adjusted to 70 cm long by intentionally displacing the fibers using a hackling. The fiber bundle then was tied in the middle with a string, folded in two, and the string portion was fixed. The fiber bundle was fixed with an insulation lock at a portion 30 cm away from the tips of the fibers. Thus, a fiber bundle for hair ironing was prepared. Next, a hair iron ("GOLD N HOT Professional Ceramic Spring Curling Iron 1¼ inch GH 2150" manufactured by Belson Products (U.S.)) heated at 180° C. was used to hold the tip of the fiber bundle, wind the bundle up to the base where the fiber bundle was fixed, and keep the state for three seconds. Thereafter, the fiber bundle was placed on a hand so as to keep the curl shape, and released from the hand within one second. Thus, a curled fiber bundle was prepared. A length from the insulation lock, which fixed the upper end of the curled fiber bundle, to the lower end of the fiber bundle was measured (initial curl length). The curl setting property during hair iron setting was determined based on the initial curl length and the curl strength under the following criteria.

A: The curl strength is high and the curl style is excellent, which is equivalent to those of 100% human hair fibers (fineness: 68 dtex, commercially available Chinese hair) without cooling (cooling time: 0 second).

B: The curl strength from the upper part to the middle part of the fibers is slightly weak but the curl strength at tips in the lower part is strong, and the curl style is at an acceptable level.

C: The curl strength is weak as a whole, and the curl style is at an unsatisfactory level.

(Curl Retentive Property)

The fiber bundle after evaluation of the curl setting property during hair iron setting was left to stand for three days with its base being fixed. Three days later, a length from the insulation lock, which fixed the upper end of the fiber bundle, to the lower end of the fiber bundle was measured (curl length after three days), and the curl loosening percentage was calculated from the following formula. The curl retentive property of the fiber was determined based on the curl length after three days and the curl shape under the following criteria. In the following formula of the curl loosening percentage, the initial curl length and the curl length after three days are both expressed in the unit "cm".

$$\text{Curl loosening percentage}(\%)=100-[(30-\text{curl length after three days})/(30-\text{initial curl length})]\times 100$$

A: The curl loosening percentage is 0% or more and less than 5%, a change in style from that immediately after curling is low, and curls as a whole remain spirally.

B: The curl loosening percentage is 5% or more and less than 10%, a change in style from that immediately after curling is relatively low, and curls as a whole remain spirally.

C: The curl loosening percentage is 10% or more, curls as a whole become weak as compared with the style immediately after curling, and curls remain only at their tips.

(Combing Property)

Fibers were cut into 63.5 cm long, and 5.0 g of the 63.5 cm-long fibers obtained was bundled. The fiber bundle was then tied in the middle with a string, folded in two, and the string portion was fixed. Thus, a fiber bundle for hair ironing was prepared. Next, a hair iron ("IZUNAMI ITC450 Flat Iron" manufactured by Izunami Inc. (U.S.)) heated at 180° C. was used to heat the fiber bundle while crimping the bundle from the base, where the fiber bundle was fixed, to the tip. This process was repeated five times. Thus, a fiber bundle for combing property evaluation was prepared. Thereafter, the fiber bundle for combing property evaluation was combed one hundred times from the fixed base to the tip using a hair comb "MATADOR PROFESSIONAL 386.8 1/2F", made in Germany). The combing property was evaluated from the number of deformed or split fibers under the following criteria.

A: The number of deformed or split fibers after one hundred times of combining is less than 10, and the fibers are combed through to the end with no resistance.

B: The number of deformed or split fibers after one hundred times of combining is 10 or more and less than 30, and the fibers are combed through to the end although the resistance is slightly high in the middle.

C: The number of deformed or split fibers after one hundred times of combining is 30 or more and less than 100, the fibers are combed with high resistance in the middle, and the comb cannot pass through to the end with a probability of once to less than 20 times in 100 times.

D: The number of deformed or split fibers after one hundred times of combining is 100 or more, the fibers are combed with high resistance in the middle, and the comb cannot pass through to the end with a probability of 20 times or more in 100 times.

Example 1

100 parts by weight of polyethylene terephthalate that was dried to a moisture content of 100 ppm or less, 20 parts by weight of brominated epoxy-based flame retardant, and 2 parts by weight of sodium antimonate were dry blended. The mixture obtained was supplied to a twin-screw extruder and melt kneaded at 280° C., and then was formed into pellets. The pellets obtained were dried to a moisture content of 100 ppm or less. Next, the dried pellets were supplied to a melt spinning machine, and a molten polymer was extruded through a spinneret with a nozzle having the shape indicated in Table 1 below at a barrel temperature of 280° C. The extruded polymer was passed through a heated tube, cooled to a temperature of not more than the glass transition temperature of the polyethylene terephthalate, and wound up at a speed of 60 to 150 m/min Thus, spun yarns (undrawn yarns) were obtained. Fibers of Example 1 were obtained by configuring a nozzle hole in the nozzle having the shape indicated in Table 1 below so as to support a hollow portion by providing a lattice 500 in a land of a nozzle 400 as shown in FIG. 8A. The obtained spun yarns were drawn to 3 times at 80° C., and heat-treated using a heating roller at 200° C.

Thus, polyester-based fibers (multifilaments) with a single fiber fineness of about 65 dtex were produced. The single fiber fineness was measured as described above, and the same applied to the following.

Example 2

Polyester-based fibers (multifilaments) with a single fiber fineness of about 60 dtex were produced in the same manner as in Example 1 except that in the nozzle shown in FIG. 8A, sizes a, b, c, d, and e in the outer circumference portion and the hollow portion were changed to 1.10 times, 0.93 times, 1.04 times, 0.87 times, and 0.88 times, respectively.

Example 3

Polyester-based fibers (multifilaments) with a single fiber fineness of about 60 dtex were produced in the same manner as in Example 1 except that in the nozzle shown in FIG. 8A, the sizes a, b, c, d, and e in the outer circumference portion and the hollow portion were changed to 1.10 times, 0.93 times, 1.04 times, 1.00 time, and 0.92 times, respectively.

Example 4

Polyester-based fibers (multifilaments) with a single fiber fineness of about 75 dtex were produced in the same manner as in Example 1, except that 100 parts by weight of polyethylene terephthalate that was dried to a moisture content of 100 ppm or less, 10 parts by weight of polycarbonate that was dried to a moisture content of 100 ppm or less, 20 parts by weight of brominated epoxy-based flame retardant, and 2 parts by weight of antimony trioxide were dry blended, and the mixture obtained was supplied to a twin-screw extruder and melt kneaded at 280° C., and then was formed into pellets, and that in the nozzle shown in FIG. 8A, the sizes a, b, c, d, and e in the outer circumference portion and the hollow portion were changed to 1.10 times, 0.94 times, 1.00 time, 1.07 times, and 1.08 times, respectively.

Example 5

Polyester-based fibers (multifilaments) with a single fiber fineness of about 75 dtex were produced in the same manner as in Example 1 except that polyethylene terephthalate that was dried to a moisture content of 100 ppm or less was supplied to a twin-screw extruder and melt kneaded at 280° C., and then was formed into pellets.

Example 6

Polyamide-based fibers (multifilaments) with a single fiber fineness of about 100 dtex were produced in the same manner as in Example 1, except that nylon 66 that was dried to a moisture content of 100 ppm or less was supplied to a twin-screw extruder and melt kneaded at 300° C., and then was formed into pellets, and that a molten polymer was extruded through a spinneret at a barrel temperature of 300° C., and that the extruded polymer after passing through a heated tube was cooled to a temperature of not more than the glass transition temperature of the nylon 66.

Example 7

Polyester-based fibers (multifilaments) with a single fiber fineness of about 70 dtex were produced in the same manner as in Example 1 except that in the nozzle shown in FIG. 8A, the sizes a, b, c, d, and e in the outer circumference portion and the hollow portion were changed to 1.10 times, 0.68 times, 0.77 times, 1.15 times, and 0.75 times, respectively.

Example 8

Polyester-based fibers (multifilaments) with a single fiber fineness of about 75 dtex were produced in the same manner as in Example 1 except that in the nozzle shown in FIG. 8A, the sizes a, b, c, d, and e in the outer circumference portion and the hollow portion were changed to 0.93 times, 0.74 times, 0.92 times, 0.61 times, and 0.94 times, respectively.

Comparative Example 1

Polyester-based fibers (multifilaments) with a single fiber fineness of about 55 dtex were produced in the same manner as in Example 1 except that a spinneret with a nozzle having the shape indicated in Table 1 below was used. Fibers of Comparative Example 1 were obtained by configuring a nozzle hole in the nozzle having the shape indicated in Table 1 below so as to support a hollow portion by providing a lattice 510 in a land of a nozzle 410 as shown in FIG. 8B.

Comparative Example 2

Polyester-based fibers (multifilaments) with a single fiber fineness of about 65 dtex were produced in the same manner as in Example 1 except that a spinneret with a nozzle having the shape indicated in Table 1 below was used.

Comparative Example 3

Polyamide-based fibers (multifilaments) with a single fiber fineness of about 100 dtex were produced in the same manner as in Comparative Example 2, except that nylon 66 that was dried to a moisture content of 100 ppm or less was supplied to a twin-screw extruder and melt kneaded at 300° C., and then was formed into pellets, and that a molten polymer was extruded through a spinneret at a barrel temperature of 300° C., and that the extruded polymer after passing through a heated tube was cooled to a temperature of not more than the glass transition temperature of the nylon 66.

Comparative Example 4

Polyester-based fibers (multifilaments) with a single fiber fineness of about 70 dtex were produced in the same manner as in Example 1 except that in the nozzle shown in FIG. 8A, the sizes a, b, c, d, and e in the outer circumference portion and the hollow portion were changed to 0.93 times, 0.74 times, 0.92 times, 0.49 times, and 0.94 times, respectively.

The fiber cross sections of the fibers of Examples 1 to 8 and Comparative Examples 1 to 4 were evaluated by the evaluation methods described above, and the results are shown in Table 1 below. The curl setting property during hair iron setting, curl retentive property, and combing property of the fibers of Examples 1 to 8 and Comparative Examples 1 to 4 were evaluated by the evaluation methods described above, and the results are shown in Table 1 below. Regarding the respective measured values of the fiber cross sections, Table 1 below indicates the maximum values, average values, and minimum values of the respective measured values in 30 fiber cross sections used in the measurements.

TABLE 1

| | | | Ex. 1 | Ex. 2 | Ex. 3 | Ex. 4 | Ex. 5 | Ex. 6 | Ex. 7 | Ex. 8 | Comp. Ex. 1 | Comp. Ex. 2 | Comp. Ex. 3 | Comp. Ex. 4 |
|---|---|---|---|---|---|---|---|---|---|---|---|---|---|---|
| Nozzle | Outer circumferential shape | | Spectacles | Spectacles | Spectacles | Spectacles | Spectacles | Spectacles | Spectacles | Spectacles | Circle | Spectacles | Spectacles | Spectacles |
| | Hollow shape | | Quadrangle | Quadrangle | Quadrangle | Quadrangle | Quadrangle | Quadrangle | Quadrangle | Quadrangle | Circle | No hollow (Nonhollow) | No hollow (Nonhollow) | Quadrangle |
| Fiber cross section | Fiber cross-sectional micrograph | | FIG. 9 | FIG. 15A | FIG. 15B | FIG. 15C | FIG. 15D | FIG. 15E | FIG. 15F | FIG. 15G | FIG. 11 | FIG. 13 | Not | FIG. 15H |
| | Ratio of the major axis to the first minor axis | Maximum value | 1.4 | 1.4 | 1.5 | 1.5 | 1.4 | 1.4 | 1.9 | 1.4 | 1.1 | 1.6 | 1.6 | 1.5 |
| | | Average value | 1.3 | 1.3 | 1.4 | 1.3 | 1.3 | 1.3 | 1.7 | 1.3 | 1.1 | 1.5 | 1.5 | 1.3 |
| | | Minimum value | 1.2 | 1.2 | 1.3 | 1.2 | 1.2 | 1.2 | 1.7 | 1.1 | 1.0 | 1.4 | 1.4 | 1.1 |
| | Angle of the first side of the hollow relative to the | Maximum value | 96 | 95 | 94 | 97 | 100 | 102 | 94 | 97 | — | — | — | 100 |
| | | Average value | 92 | 90 | 88 | 92 | 91 | 88 | 90 | 92 | — | — | — | 92 |
| | | Minimum value | 83 | 81 | 81 | 88 | 87 | 77 | 87 | 86 | — | — | — | 86 |
| | Angle of the second side of the hollow relative to the | Maximum value | 94 | 99 | 95 | 94 | 94 | 96 | 94 | 95 | — | — | — | 99 |
| | | Average value | 88 | 90 | 90 | 91 | 89 | 89 | 91 | 91 | — | — | — | 92 |
| | | Minimum value | 81 | 86 | 82 | 85 | 83 | 81 | 85 | 84 | — | — | — | 86 |
| | Length of the first side of the hollow (μm) | Maximum value | 25.5 | 12.1 | 9.6 | 22.8 | 19.0 | 23.7 | 17.4 | 26.8 | — | — | — | 25.8 |
| | | Average value | 19.5 | 10.3 | 7.8 | 19.7 | 16.8 | 19.4 | 15.8 | 21.1 | — | — | — | 21.1 |
| | | Minimum value | 16.5 | 8.2 | 5.7 | 16.8 | 13.6 | 16.2 | 13.4 | 16.4 | — | — | — | 17.0 |
| | Length of the second side of the hollow (nm) | Maximum value | 22 | 12.8 | 10.4 | 23.6 | 18.1 | 22.9 | 18.4 | 26.3 | — | — | — | 25.5 |
| | | Average value | 19.3 | 11.2 | 8.9 | 20.5 | 15.6 | 19.7 | 16.2 | 20.9 | — | — | — | 21.1 |
| | | Minimum value | 16.5 | 9.3 | 7.5 | 18.0 | 12.8 | 16.5 | 13.8 | 14.1 | — | — | — | 18.0 |
| | Ratio of average distance between sides of hollow to average distance between minor axes of cross section (%) | Maximum value | 133 | 115 | 135 | 135 | 117 | 133 | 102 | 46 | — | — | — | 27 |
| | | Average value | 126 | 99 | 128 | 124 | 112 | 115 | 95 | 37 | — | — | — | 23 |
| | | Minimum value | 116 | 91 | 114 | 108 | 105 | 101 | 86 | 29 | — | — | — | 20 |
| | Fineness (dtex) | Maximum value | 88.2 | 67.1 | 75.9 | 86.7 | 84.6 | 117.3 | 80.7 | 108.1 | 77 | 107.6 | 140.3 | 85.1 |
| | | Average value | 67.3 | 61.5 | 62.0 | 74.6 | 73.1 | 99.6 | 71.7 | 75.8 | 54.7 | 66.3 | 103.0 | 70.6 |
| | | Minimum value | 53.4 | 49.2 | 46.8 | 63.5 | 64.6 | 81.5 | 64.6 | 51.9 | 34 | 37.4 | 62.8 | 52.7 |
| | Hollow area ratio (%) | Maximum value | 21.1 | 12.1 | 12.6 | 19.5 | 15.7 | 14.3 | 18.3 | 7.1 | 20.5 | 0 | 0 | 4.6 |
| | | Average value | 19.2 | 10.4 | 10.8 | 18.5 | 15.2 | 13.2 | 16.7 | 6.2 | 19.8 | 0 | 0 | 3.9 |
| | | Minimum value | 17 | 9.1 | 9.8 | 17.3 | 14.6 | 12.1 | 15.0 | 4.8 | 18.5 | 0 | 0 | 3.1 |
| | Fiber cross-sectional micrograph after hair iron setting | | FIG. 10 | Not shown | Not shown | Not shown | Not shown | Not shown | Not shown | Not shown | FIG. 12 | FIG. 14 | Not shown | Not shown |
| Curl setting | Initial curl length (cm) | | 28.6 | 28.8 | 28.8 | 28.2 | 28.5 | 26.7 | 28.8 | 28.9 | 28.2 | 29.3 | 27.6 | 29.5 |
| | Judgment | | B | B | B | B | B | A | B | B | B | C | B | C |
| Curl retentive | Curl loosening percentage (%) | | 0 | 4.2 | 4.2 | 2.7 | 0 | 9.1 | 4.2 | 8.7 | 5.6 | 14.3 | 16.7 | 10 |
| | Judgment | | A | A | A | A | A | B | A | B | B | C | C | C |
| Combing property after hair iron setting | | | A | A | A | A | A | A | A | A | D | A | A | A |

*Ex.: Example,
Comp. Ex.: Comparative Example

The following were confirmed from the results of Table 1. The fibers of Examples 1 to 8 exhibited a favorable curl setting property during hair iron setting and a favorable curl retentive property even if the cooling time was as short as one second or less, and were excellent in curl properties and combing property after hair iron setting, wherein each fiber has a flat multilobed cross section, specifically, a flat two-lobed (substantially cocoon-shaped) cross section comprising two circles or two ellipses connected via recessed portions, and in the center of the fiber cross section, each fiber has a hollow with a first side and a second side that are substantially perpendicular to the major axis of the fiber cross section. Meanwhile, the fibers of Comparative Example 1 with a circular hollow had a significantly reduced combing property. The fibers of Comparative Examples 2 to 3 without a hollow and the fibers of Comparative Example 4 with a hollow ratio of less than 5% had a very poor curl retentive property when curing with hair iron. Moreover, the fibers of Comparative Examples 2 and 4 had a poor curl setting property during hair iron setting.

Figure 13:
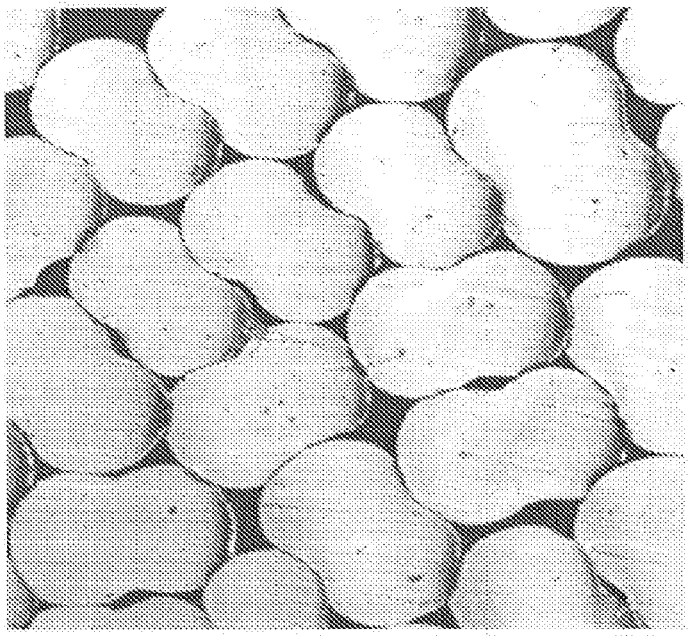
FIG. 13 is a scanning electron micrograph (400×) of fiber cross sections of fibers of Comparative Example 2.
Figure 14:
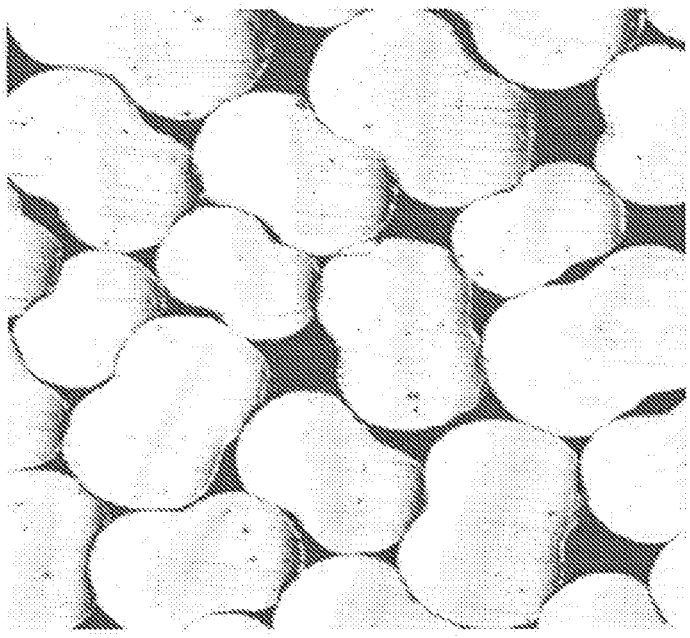
FIG. 14 is a scanning electron micrograph (400×) of fiber cross sections of the fibers of Comparative Example 2 after curling with a hair iron.
Figure 15A:
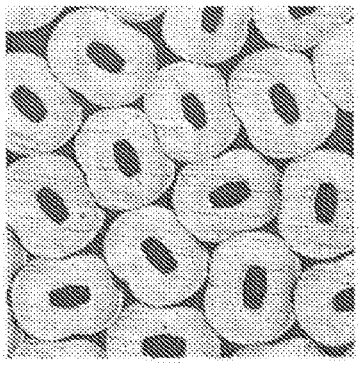
FIGS. 15A-15H respectively are scanning electron micrographs (400×) of fiber cross sections of fibers of Examples 2-8 and Comparative Example 4.
Figure 15B:
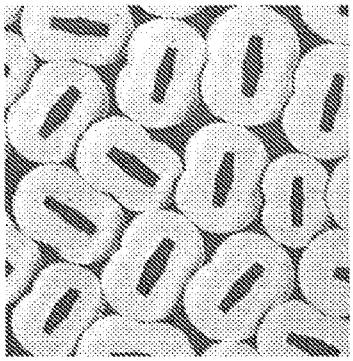
Figure 15C:
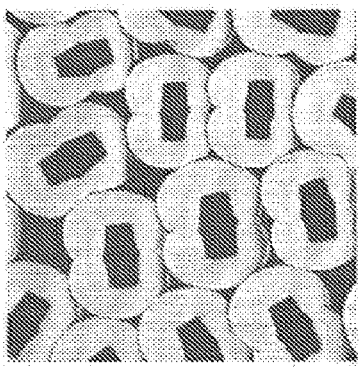
Figure 15D:
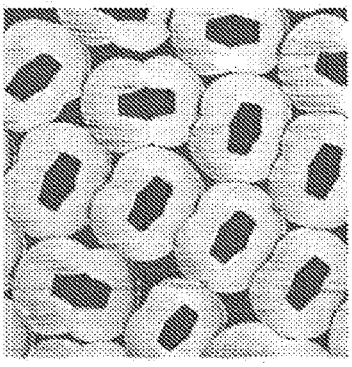
Figure 15E:
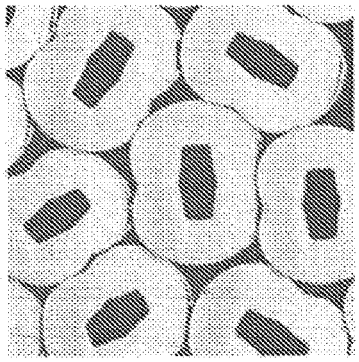
Figure 15F:
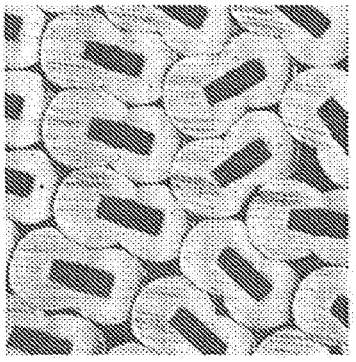
Figure 15G:
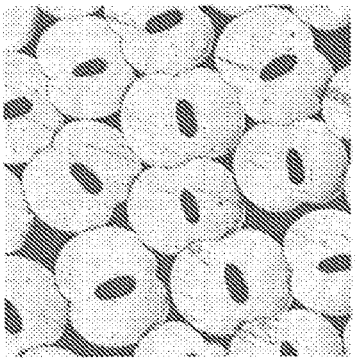
Figure 15H:
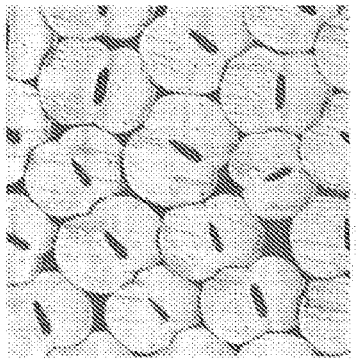

FIGS. 9 to 15 are scanning electron micrographs (400×) of the fiber cross sections of the fibers of Examples 1 to 8 and Comparative Examples 1, 2, and 4. FIG. 9 is a micrograph of the fiber cross sections of the fibers of Example 1, and FIG. 10 is a micrograph of the fiber cross sections of the fibers of Example 1 after hair iron setting. FIG. 11 is a micrograph of the fiber cross sections of the fibers of Comparative Example 1, and FIG. 12 is a micrograph of the fiber cross sections of the fibers of Comparative Example 1 after hair iron setting. FIG. 13 is a micrograph of the fiber cross sections of fibers of Comparative Example 2, and FIG. 14 is a micrograph of the fiber cross sections of the fibers of Comparative Example 2 after hair iron setting. FIGS. 15A-15H respectively are micrographs of the fiber cross sections of the fibers of Examples 2 to 8 and Comparative Example 4. FIG. 15A is a micrograph of the fiber cross sections of the fibers of Example 2, FIG. 15B is a micrograph of the fiber cross sections of the fibers of Example 3, FIG. 15C is a micrograph of the fiber cross sections of the fibers of Example 4, FIG. 15D is a micrograph of the fiber cross sections of the fibers of Example 5, FIG. 15E is a micrograph of the fiber cross sections of the fibers of Example 6, FIG. 15F is a micrograph of the fiber cross sections of the fibers of Example 7, FIG. 15G is a micrograph of the fiber cross sections of the fibers of Example 8, and FIG. 15H is a micrograph of the fiber cross sections of the fibers of Comparative Example 4.

As can be seen from a comparison between FIG. 9 and FIG. 10, the fibers of Example 1 had almost no cross-sectional deformation after hair iron setting, wherein each fiber has a flat two-lobed cross section comprising two circles or two ellipses connected via recessed portions, and in the center of the fiber cross section, each fiber has a hollow with a first side and a second side that are substantially perpendicular to the major axis of the fiber cross section, specifically, the hollow having a hexagonal shape, a combined shape of a quadrangle and arcs, etc. Meanwhile, from a comparison between FIG. 11 and FIG. 12, it was confirmed that the fibers of Comparative Example 1 having a circular cross section with a circular hollow had cross-sectional deformation and a split of a part of the fibers due to crimping during hair iron setting. As can be seen from a comparison between FIG. 13 and FIG. 14, the fibers of Comparative Example 2 without a hollow had almost no cross-sectional deformation after hair iron setting. Although not shown in the drawings, it was confirmed that the fibers of Examples 2 to 8 had almost no cross-sectional deformation after hair iron setting.

DESCRIPTION OF REFERENCE NUMERALS

1, 100 fiber cross section
11 major axis
12*a* first minor axis
12*b* second minor axis
10*a*, 10*b* circle or ellipse
20*a*, 20*b* recessed portion
21*a*, 21*b* bottom point of the recessed portion
22 straight line connecting bottom points of two recessed portions
30, 110 hollow
111 both ends of the hollow
31*a* first side of the hollow
31*b* second side of the hollow
200 external pressure
300 stress
400, 410 nozzle
500, 510 lattice

The invention claimed is:

1. An artificial hair comprising a thermoplastic fiber having a cross section comprising an outer circumference and a hollow center, wherein the outer circumference has a shape comprising two overlapping circles or two overlapping ellipses directly connected by recessed portions, wherein the recessed portions have a form of arcs, or each recessed portion has a bottom point formed by the two overlapping circles or ellipses forming acute angles in the recessed portions, the hollow center is non-circular or non-elliptical and has a shape of a quadrangle, a hexagon, a combination of a quadrangle and an arc or a combination of a hexagon and an arc, the hollow center is located in the center of the cross section and a ratio of an area of the hollow center to an area of the cross section is from 10% to 40%, an average value of a maximum straight line distance and a minimum straight line distance between a first side and a second side of the hollow center is from 50% to 150% relative to an average value of a maximum straight line distance and a minimum straight line distance between a first minor axis and a second minor axis in the cross section, the thermoplastic fiber comprises a polyester-based resin composition comprising 100 parts by weight of a polyester resin and from 5 to 40 parts by weight of a brominated epoxy-based flame retardant, and the polyester resin is at least one selected from the group consisting of polyalkylene terephthalate and a copolymerized polyester comprising polyalkylene terephthalate.

2. The artificial hair of claim 1, wherein the first side and the second side of the hollow center are inclined 70 to 110 degrees relative to a major axis of the cross section, and the first side and the second side of the hollow center have a length of from 5 μm to 50 μm.

3. The artificial hair of claim 1, wherein a ratio of a length of a major axis to a length of the first minor axis in the cross section is from 1.2 to 3.0.

4. The artificial hair of claim 1, wherein the thermoplastic fiber further comprises at least one resin composition selected from the group consisting of a polyamide-based resin composition, a vinyl chloride-based resin composition, a modacrylic-based resin composition, a polycarbonate-based resin composition, and a polyphenylene sulfide-based resin composition.

5. The artificial hair of claim 1, wherein the thermoplastic fiber is curved by gear crimping.

6. A hair ornament product, comprising:

a thermoplastic fiber having a cross section comprising an outer circumference and a hollow center, wherein the outer circumference has a shape comprising two overlapping circles or two overlapping ellipses directly connected by recessed portions, wherein the recessed portions have a form of arcs, or each recessed portion has a bottom point formed by the two overlapping circles or ellipses forming acute angles in the recessed portions, the hollow center is non-circular or non-elliptical and has a shape of a quadrangle, a hexagon, a combination of a quadrangle and an arc, or a combination of a hexagon and an arc, the hollow center is located in the center of the cross section and a ratio of an area of the hollow center to an area of the cross section is from 10% to 40%, an average value of a maximum straight line distance and a minimum straight line distance between a first side and a second side of the hollow center is from 50% to 150% relative to an average value of a maximum straight line distance and a minimum straight line distance between a first minor axis and a second minor axis in the cross section, the thermoplastic fiber comprises a polyester-based resin composition comprising 100 parts by weight of a polyester resin and from 5 to 40 parts by weight of a brominated epoxy-based flame retardant, and the polyester resin is at least one selected from the group consisting of polyalkylene terephthalate and a copolymerized polyester comprising polyalkylene terephthalate.

7. The hair ornament product of claim 6, wherein the hair ornament product is at least one selected from the group consisting of a hair wig, a hairpiece, weaving hair, a hair extension, braided hair, a hair accessory, and doll hair.

8. The hair ornament product of claim 6, wherein the hair ornament product is heat-treated at a temperature of from 120° C. to 240° C. with a hair iron.

9. The hair ornament product of claim 6, wherein a ratio of a length of a major axis to a length of the first minor axis in the cross section is from 1.2 to 3.0.

10. The hair ornament product of claim 6, wherein the first side and the second side of the hollow center are inclined 70 to 110 degrees relative to a major axis of the cross section, and the first side and the second side of the hollow center have a length of from 5 μm to 50 μm.

11. The hair ornament product of claim 6, wherein the thermoplastic fiber further comprises at least one resin composition selected from the group consisting of a polyamide-based resin composition, a vinyl chloride-based resin composition, a modacrylic-based resin composition, a polycarbonate-based resin composition, and a polyphenylene sulfide-based resin composition.

12. The hair ornament product of claim 6, wherein the thermoplastic fiber is curved by gear crimping.

13. A method for forming a thermoplastic fiber for artificial hair, wherein the thermoplastic fiber has a cross section comprising an outer circumference and a hollow center, the outer circumference has a shape comprising two overlapping circles or two overlapping ellipses directly connected by recessed portions, wherein the recessed portions have a form of arcs, or each recessed portion has a bottom point formed by the two overlapping circles or ellipses forming acute angles in the recessed portions, the hollow center is non-circular or non-elliptical and has a shape of a quadrangle, a hexagon, a combination of a quadrangle and an arc, or a combination of a hexagon and an arc, the hollow center is located in the center of the cross section and a ratio of an area of the hollow center to an area of the cross section is from 10% to 40%, an average value of a maximum straight line distance and a minimum straight line distance between a first side and a second side of the hollow center is from 50% to 150% relative to an average value of a maximum straight line distance and a minimum straight line distance between a first minor axis and a second minor axis in the cross section, the thermoplastic fiber comprises a polyester-based resin composition comprising 100 parts by weight of a polyester resin and from 5 to 40 parts by weight of a brominated epoxy-based flame retardant, and the polyester resin is at least one selected from the group consisting of polyalkylene terephthalate and a copolymerized polyester comprising polyalkylene terephthalate;

the method comprising:

dry blending a resin composition to form a polymer mixture;

extruding the mixture to form polymer pellets;

drying the polymer pellets;

melting the dried polymer pellets in a melt spinning machine; and extruding the melted polymer pellets through a spinneret to obtain the thermoplastic fibers, wherein the spinneret comprises a cocoon-shaped or spectacle-shaped nozzle and a quadrangle-shaped nozzle hole.

14. The artificial hair of claim 1, wherein the recessed portions have a form of arcs.

15. The artificial hair of claim 1, wherein each recessed portion has a bottom point formed by the two overlapping circles or ellipses forming acute angles in the recessed portions.

16. The artificial hair of claim 15, wherein a ratio of a distance between the bottom points of the recessed portions to a length of the first minor axis is from 0.5 to less than 1.

17. The artificial hair of claim 1, wherein the outer circumference has a shape consisting of the two overlapping circles or the two overlapping ellipses directly connected by the recessed portions.

18. The artificial hair of claim 1, wherein each recessed portion has the bottom point formed by the two overlapping circles or ellipses forming acute angles in the recessed portions, wherein the bottom point of the each recessed portion is a direct crossing point of the two overlapping circles or ellipses in the recessed portions, wherein a shortest straight line distance between two bottom points in the recessed portions connecting the direct crossing points of the two overlapping circles or ellipses in the recessed portions is shorter than a shortest straight line distance between a bottom of the arches when the recessed portions have the form of arches.

19. The hair ornament product of claim 6, wherein each recessed portion has the bottom point formed by the two overlapping circles or ellipses forming acute angles in the recessed portions, wherein the bottom point of the each recessed portion is a direct crossing point of the two overlapping circles or ellipses in the recessed portions, wherein a shortest straight line distance between two bottom points in the recessed portions connecting the direct crossing points of the two overlapping circles or ellipses in the recessed portions is shorter than a shortest straight line distance between a bottom of the arches when the recessed portions have the form of arches.

20. The method of claim 13, wherein each recessed portion has the bottom point formed by the two overlapping circles or ellipses forming acute angles in the recessed portions, wherein the bottom point of the each recessed portion is a direct crossing point of the two overlapping circles or ellipses in the recessed portions, wherein a shortest straight line distance between two bottom points in the recessed portions connecting the direct crossing points of the two overlapping circles or ellipses in the recessed portions is shorter than a shortest straight line distance between a bottom of the arches when the recessed portions have the form of arches.

* * * * *